US007517625B2

(12) United States Patent
Suzuki et al.

(10) Patent No.: US 7,517,625 B2
(45) **Date of Patent: *Apr. 14, 2009**

(54) IMAGE FORMING APPARATUS AND PROCESS CARTRIDGE

(75) Inventors: Yasuo Suzuki, Fuji (JP); Michitaka Sasaki, Chiba (JP); Tetsuro Suzuki, Fuji (JP); Kohichi Ohshima, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 500 days.

This patent is subject to a terminal disclaimer.

(21) Appl. No.: 11/218,657

(22) Filed: Sep. 6, 2005

(65) Prior Publication Data

US 2006/0051689 A1 Mar. 9, 2006

(30) Foreign Application Priority Data

Sep. 6, 2004 (JP) ..... 2004-257823

(51) Int. Cl.
*G03G 15/04* (2006.01)

(52) U.S. Cl. ..... 430/66; 430/58.05; 399/159

(58) Field of Classification Search ..... 430/66, 430/58.05; 399/159
See application file for complete search history.

(56) References Cited

U.S. PATENT DOCUMENTS 5,374,494 A * 12/1994 Kashimura et al. ..... 430/67

(Continued)

FOREIGN PATENT DOCUMENTS

| | | |
|---|---|---|
| JP | 56-048637 | 5/1981 |
| JP | 64-001728 | 1/1989 |
| JP | 04-281461 | 10/1992 |
| JP | 05-216249 | 8/1993 |

(Continued)

OTHER PUBLICATIONS

U.S. Appl. No. 12/000,239, filed Dec. 11, 2007, Fujiwara et al.

(Continued)

*Primary Examiner*—Mark A Chapman
(74) *Attorney, Agent, or Firm*—Oblon, Spivak, McClelland, Maier & Neustadt, P.C.

(57) ABSTRACT

An image forming apparatus including:
an electrophotographic photoreceptor;
a non-contact charger located close to the electrophotographic photoreceptor, charging the electrophotographic photoreceptor;
an irradiator irradiating the electrophotographic photoreceptor to form an electrostatic latent image thereon;
an image developer developing the electrostatic latent image with a toner to form a toner image on the electrophotographic photoreceptor; and
a transferer transferring the toner image onto a transfer material,
wherein the electrophotographic photoreceptor comprises:
an electroconductive substrate;
a charge generation layer located overlying the electroconductive substrate;
a charge transport layer located overlying the charge generation layer; and
a crosslinked charge transport layer, located overlying the charge transport layer,
wherein the crosslinked charge transport layer is formed by hardening a radical polymeric monomer having three or more functional groups without a charge transport structure and a radical polymeric compound having one functional group with a charge transporting structure.

8 Claims, 2 Drawing Sheets

U.S. PATENT DOCUMENTS

| | | | | |
|---|---|---|---|---|
| 5,492,784 | A | 2/1996 | Yoshikawa et al. | |
| 5,578,405 | A | 11/1996 | Ikegami et al. | |
| 5,665,500 | A | 9/1997 | Suzuki | |
| 5,871,876 | A | 2/1999 | Ikuno et al. | |
| 5,928,828 | A | 7/1999 | Suzuki | |
| 6,026,262 | A | 2/2000 | Kinoshita et al. | |
| 6,030,733 | A | 2/2000 | Kami et al. | |
| 6,066,428 | A | 5/2000 | Katayama et al. | |
| 6,136,483 | A | 10/2000 | Suzuki et al. | |
| 6,151,468 | A | 11/2000 | Kami et al. | |
| 6,180,303 | B1 * | 1/2001 | Uematsu et al. | 430/59.6 |
| 6,194,535 | B1 | 2/2001 | Katayama et al. | |
| 6,210,848 | B1 | 4/2001 | Nagai et al. | |
| 6,372,397 | B1 * | 4/2002 | Maruyama et al. | 430/59.6 |
| 6,416,915 | B1 * | 7/2002 | Kikuchi et al. | 430/56 |
| 6,861,188 | B2 | 3/2005 | Ikegami et al. | |
| 6,899,983 | B2 | 5/2005 | Tamoto et al. | |
| 7,175,957 | B2 * | 2/2007 | Suzuki et al. | 430/66 |
| 7,179,573 | B2 * | 2/2007 | Suzuki et al. | 430/66 |
| 2003/0077531 | A1 | 4/2003 | Suzuki et al. | |
| 2004/0053152 | A1 | 3/2004 | Nagai et al. | |
| 2004/0126687 | A1 | 7/2004 | Ikegami et al. | |
| 2004/0170911 | A1 | 9/2004 | Shimada et al. | |
| 2004/0180280 | A1 | 9/2004 | Ikegami et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |
| 2005/0175911 | A1 | 8/2005 | Tamoto et al. | |

FOREIGN PATENT DOCUMENTS

| | | |
|---|---|---|
| JP | 08-160648 | 6/1996 |
| JP | 08-262779 | 10/1996 |
| JP | 10-198053 | 7/1998 |
| JP | 10-301303 | 11/1998 |
| JP | 2000-066425 | 3/2000 |
| JP | 2001-166501 | 6/2001 |
| JP | 2001-175016 | 6/2001 |
| JP | 2002-139859 | 5/2002 |

OTHER PUBLICATIONS

U.S. Appl. No. 11/563,710, filed Nov. 28, 2006, Inaba et al.
U.S. Appl. No. 11/616,523, filed Dec. 27, 2006, Fujiwara et al.
U.S. Appl. No. 11/621,805, filed Jan. 10, 2007, Suzuki et al.
U.S. Appl. No. 11/684,520, filed Mar. 9, 2007, Toshine et al.
U.S. Appl. No. 11/685,441, filed Mar. 13, 2007, Yanagawa et al.
U.S. Appl. No. 11/692,682, filed Mar. 28, 2007, Mori et al.
U.S. Appl. No. 09/679,480, filed Oct. 5, 2000, Suzuki et al.
U.S. Appl. No. 10/944,003, filed Sep. 20, 2004, Yanagawa et al.
U.S. Appl. No. 11/480,517, filed Jul. 5, 2006, Yanagawa et al.
U.S. Appl. No. 11/500,352, filed Aug. 8, 2006, Toshine et al.
U.S. Appl. No. 11/229,749, filed Sep. 20, 2005, Ohshima et al.
U.S. Appl. No. 11/165,279, filed Jun. 24, 2005, Ohshima et al.
U.S. Appl. No. 12/035,016, filed Feb. 21, 2008, Iwamoto et al.
U.S. Appl. No. 12/047,011, filed Mar. 12, 2008, Kami et al.

* cited by examiner

IMAGE FORMING APPARATUS AND PROCESS CARTRIDGE

BACKGROUND OF THE INVENTION

1. Field of the Invention

The present invention relates to an electrophotographic image forming apparatus and a process cartridge for use in electrostatic copiers and laser printers, etc.

2. Discussion of the Background

Organic photoreceptors are mostly used in image forming apparatus using electrophotographic process because of having many advantages of being more low-cost, less toxicity, easier-to-coat, etc. than inorganic photoreceptors having been vacuum-evaporated with selenium. Particularly, the organic photoreceptors wherein a charge generation layer and a charge transport layer are layered on an electroconductive substrate are mostly used.

However, the organic photoreceptor is liable to be abraded when repeatedly used, which causes deterioration of the charge potential and photosensitivity thereof and damages of the surface thereof, resulting in background fouling and deterioration of image density of the resultant images. Therefore, improvement of the abrasion resistance and scratch resistance of the organic photoreceptor is desired.

Further, the improvement of the abrasion resistance of the photoreceptor is essential because of the recent higher-speed of electrophotographic apparatus, smaller diameter of the photoreceptor with downsizing of the apparatus, and further full-colorization and free maintenance thereof. Therefore, it is most essential for the organic electrophotographic photoreceptor to produce high-quality images and have high durability.

Various materials are added into the charge transport layer to improve property of the surface of the photoreceptor and durability thereof.

Japanese Laid-Open Patent Publications Nos. 10-198053 and 10-301303 disclose that an electrophotographic photoreceptor including an epoxy compound and a hindered amine or phenol compound having a specific constitution in its photosensitive layer has high durability of not changing electrical properties such as charge potential and residual potential, and not changing sensitivity and image quality without swollen letters and blurred images.

Japanese Laid-Open Patent Publication No. 10-198053 and 10-301303 disclose that an electrophotographic photoreceptor including a polytetrafluoroethylene powder as a lubricant and 4,4-diphenyl-1,1-di(P-di-lower-alkyl-substituted amino phenyl)-butadiene having a formula $(C_6H_5)_2(C_6H_5P—NR_2)_2$ in a surface layer of its photosensitive layer as a charge transport material has durability against abrasion due to friction and scratch, produces high-quality images without blur and has good cleanability without toner adherence to the surface thereof.

Japanese Laid-Open Patent Publication No. 2002-139859 discloses that an electrophotographic photoreceptor including an electroconductive substrate, a photosensitive layer thereon and a protective layer including a filler thereon, wherein the photosensitive layer includes an organic sulfuric compound and the protective layer includes both a hindered amine constitution and a hindered phenol constitution, does not increase the residual potential, does not produce poor images such as blurred images, and stably produce high-quality images for long periods.

However, any of these conventional technologies are insufficient in terms of simultaneous pursuit of higher-quality image and higher durability.

For example, the polytetrafluoroethylene powder disclosed in Japanese Laid-Open Patent Publication No. 10-198053 is a polymer having a low surface energy, and is insoluble in a solvent and has poor dispersibility, resulting in difficulty in preparing a photoreceptor having a smooth surface. Although the dispersibility can be improved with a dispersant, light tends to scatter because the resultant coated layer has a small flexibility, resulting in deterioration of latent images and production of blurred images.

In addition, the photoreceptor disclosed in Japanese Laid-Open Patent Publication No. 2002-139859 has good durability, but does not produce such high-quality images as the photoreceptor of the present invention does.

Further, as conventional technologies to improve the abrasion resistance, (1) Japanese Laid-Open Patent Publication No. 56-48637 discloses a hardening binder used in a crosslinked charge transport layer, (2) Japanese Laid-Open Patent Publication No. 64-1728 discloses a charge transport polymer material, and (3) Japanese Laid-Open Patent Publication No. 4-281461 discloses an inorganic filler dispersed in a crosslinked charge transport layer. A photoreceptor using the (1) hardening binder tends to increase the residual potential and produce images having low image density because of poor compatibility of the hardening binder with a charge transport material and impurities such as a polymerization initiator and an unreacted residue. A photoreceptor using the (2) charge transport polymer material has good abrasion resistance, but does not have satisfactory durability. In addition, the charge transport polymer material is difficult to polymerize and purify, and a coating liquid including the charge transport polymer material has high viscosity. A photoreceptor using the (3) inorganic filler has a higher abrasion resistance than a conventional photoreceptor wherein a low-molecular-weight charge transport material is dispersed in an inactive polymer, but tends to increase the residual potential and produce images having low image density because of a charge trap present on the surface of the inorganic filler. In addition, when the inorganic filler and a binder resin form large concavities and convexities on the surface of the photoreceptor, the cleanability hereof deteriorates, resulting in toner filming and distorted images. These technologies of (1), (2) and (3) do not fully satisfy an overall durability including electrical durability, mechanical durability and image durability required for an organic photoreceptor.

Further, in order to improve the abrasion resistance and the scratch resistance of the photoreceptor using the (1) hardening binder, Japanese Patent No. 3262488 discloses a photoreceptor including a hardened polyfunctional acrylate monomer. However, although disclosing that a protection layer thereof includes the hardened polyfunctional acrylate monomer, Japanese Patent No. 3262488 only discloses that a charge transport material may be included therein and does not disclose specific examples thereof. In addition, when a low-molecular-weight charge transport material is simply included in a surface layer, the low-molecular-weight charge transport material is not soluble with the hardened polyfunctional acrylate monomer and the low-molecular-weight charge transport material separates out and becomes cloud in the surface layer, and which causes deterioration of mechanical strength of the resultant photoreceptor.

Further, since the hardened polyfunctional acrylate monomer is reacted in a surface layer including a polymer binder, a three-dimensional network is not fully developed therein and the crosslinking bond density is thin, and therefore the photoreceptor does not have noticeable abrasion resistance.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin improves adhesiveness between a charge generation layer and a hardening charge transport layer, and is considered to lessen an internal stress therein when hardening. In addition, the binder resin has a carbon-carbon double bond and is broadly classified to a binder resin having a carbon-carbon double bond and reactivity with the charge transport material and a binder resin not having a carbon-carbon double bond and reactivity therewith. The photoreceptor has both good abrasion resistance and electrical property, but when the binder resin not having a reactivity with a charge transport material is used, the binder resin has poor compatibility with a hardened material produced by a reaction between the monomer and charge transport material and the crosslinked transport layer has a layer separation therein, and which occasionally causes damages, and adherence of an external additive in a toner and a paper powder on the surface of the photoreceptor. As mentioned, above, a three-dimensional network is not fully developed therein and the crosslinking bond density is thin, and therefore the photoreceptor does not have noticeable abrasion resistance. In addition, the monomer is bifunctional, which is unsatisfactory in terms of the abrasion resistance. Even when the binder resin having a reactivity with a charge transport material, although having more molecular weight, the hardened material has less intermolecular crosslinking bond. Therefore, the resultant photoreceptor does not have a sufficient crosslinking density, and the electrical and property and the abrasion resistance thereof are not satisfactory.

Japanese Laid-Open Patent Publication No. 2000-66425 discloses a photosensitive layer including a hardened positive hole transport compound having two or more chain polymeric functional groups in the same molecule. Although having a high hardness because of its high crosslinking bond density, the photosensitive layer includes a bulky positive hole transport material having two or more chain polymeric functional groups, and a distortion appears in the hardened compound and an internal stress increases to cause a crack on the crosslinked surface layer and a peeling thereof.

Further, Japanese Laid-Open Patent Publication No. 2001-166501 discloses a photosensitive layer including a positive hole transport polymer compound having two or more chain polymeric functional groups in the same molecule, and having a thickness of from 5 to 15 μm. The thickness is limited to stabilize the electrostatic properties of the photoreceptor, such as charge potential and residual potential thereof in addition to the abrasion resistance and scratch resistance thereof. The thickness does not refer to image quality and a relationship thereof with a writing light source is not referred at all.

In order to improve the abrasion resistance, a photosensitive layer or a surface protective layer including an organic silicon binder resin is practically used. However, the organic silicon binder resin has a high hygroscopicity, resulting in deterioration of image quality, such as blurred images due to toner filming and distorted images.

The reason why a photoreceptor producing high-quality images and having high durability is difficult to prepare is considered as follows.

As mentioned above, many trials have been made to realize high abrasion resistance, and the organic photoreceptor has been noticeably improved in its abrasion resistance. However, at the same time, abnormal images such as blurred images have noticeably been produced. This is because a charged product becomes difficult to remove as the abrasion resistance of the photoreceptor improves.

Namely, since a conventional photoreceptor has a low abrasion resistance, the charged product is removed with abrasion even when accumulated on the surface thereof. The blurred image is produced by a blurred electrostatic latent image due to a horizontal movement of a charge because of lowering of the surface resistivity of the photoreceptor. The surface resistivity lowers because ion species (hereinafter referred to as a charged product) produced with ozone and NOx generated when the photoreceptor is charged and atmospheric moisture are accumulated thereon. In addition, as the abrasion resistance is improved, scratches on the surface of the photoreceptor are difficult to remove and the charged products accumulated therein are more difficult to remove.

Further, besides the charged products, the time and number for the surface of the photoreceptor to be exposed stresses such as a charge noticeably increase as the abrasion resistance thereof improves. Therefore, the surface of the photoreceptor occasionally changes in quality due to ionization and bond breaking because of the stress. Although this may not cause blurred images, but the resistivity locally lowers, resulting in expansion of a dot and deterioration of image density gradation. It is not clear whether a moisture accelerates such reactions or is a medium of lowering the resistivity, however, the phenomena noticeably occurs in an environment of high-temperature and humidity. Therefore, it is essential that the photoreceptor has high abrasion resistance and produces high-quality images as well.

As mentioned above, the blurred images are produced by ozone and NOx generated when the photoreceptor is charged, and adherence and accumulation of the charged products thereon. Therefore, the blurred images can be prevented when the ozone, NOx and charged products increase.

Charges for use in the electrophotographic image forming apparatus are broadly classified to non-contact chargers like corona chargers charging the photoreceptor without contacting the photoreceptor, such as a corotron and a scorotron; and contact chargers charging the photoreceptor contacting the photoreceptor, such as a charging roller and a charging brush.

Corona chargers are simple, but generate much ozone and NOx, adversely affects the electrostatic and image properties of the photoreceptor as well as the environment. In addition, the corona chargers are disadvantageous for downsizing the apparatus. Particularly, when installed in an electrophotographic tandem image forming apparatus including plural photoreceptors and chargers, the ozone and NOx are generated more.

On the other hand, the contact chargers such as a charging roller and a charging brush can charge the photoreceptor to have a specified potential with a lower applied voltage, and therefore the ozone and NOx largely decrease. Therefore, the contact chargers have an advantage against the blurred images, and can uniformly charge the photoreceptor. However, contacting the photoreceptor, the charging member thereof is contaminated with a toner and foreign particles adhering thereto, resulting in deterioration of the chargeability of the photoreceptor; the photoreceptor is contaminated with the toner and foreign particles adhering a gain thereto; the abrasion or uneven abrasion of the photoreceptor is accelerated with the contaminated charging member; the foreign particles removability deteriorates because the charging member is pressed against the surface of the photoreceptor; and abnormal images are produced due to a trace of the charging roller on the photoreceptor or a deformation thereof.

A method of locating a charging member close to a photoreceptor can decrease the ozone and NOx as the contact chargers and can reduce the above-mentioned problems of the contact chargers as well because of not directly contacting the photoreceptor, which seems an effective method for a photoreceptor to have higher durability and produce higher quality images. In addition, the charging member in this method is not easily contaminated and easy to remove the foreign particles even when adhered thereto, and therefore the charging member and the photoreceptor have higher durability.

However, the charging member and the photoreceptor need to precisely be located each other, and the charge stability of the photoreceptor tend to rather deteriorate. An AC voltage overlapped with a DC voltage is applied to the charging member to improve the charge stability, which increases the charged products, resulting in production of blurred images. Further, a charging member located close to a conventional photoreceptor wherein a specific outermost layer is not formed on a photosensitive layer, more causes discharge breakdown of the surface of the photoreceptor. Therefore, even when a charging member is located close to a photoreceptor, the photoreceptor does not have higher durability as expected.

In order to realize a downsized and energy-saving electrophotographic image forming apparatus having high durability which does not need a replacement of a photoreceptor and a dehumidifier and producing high-quality images, the abrasion resistance of the photoreceptor needs to be improved and production of blurred images needs to be prevented. In order to prevent production of blurred images, it is essential to prevent generation of ozone and NOx and contamination of a charging member. The charging member located close to a photo receptor seems to be effectively used, however, as mentioned above, the blurred images and the discharge breakdown of the photoreceptor rather increase, and is not effective for producing high-quality images.

Because of these reasons, a need exists for a power-saving and downsized electrophotographic image forming apparatus having a long life and stably producing quality images for long periods.

SUMMARY OF THE INVENTION

Accordingly, an object of the present invention is to provide an electrophotographic image forming apparatus having high durability and stably producing quality images, wherein the abrasion resistance thereof is improved, production of abnormal images such as blurred images is prevented, and further a charging member is less contaminated.

This object and other objects of the present invention, either individually or collectively, have been satisfied by the discovery of an image forming apparatus comprising:

an electrophotographic photoreceptor;

a non-contact charger located close to the electrophotographic photoreceptor, charging the electrophotographic photoreceptor;

an irradiator irradiating the electrophotographic photoreceptor to form an electrostatic latent image thereon;

an image developer developing the electrostatic latent image with a toner to form a toner image on the electrophotographic photoreceptor; and a transferer transferring the toner image onto a transfer material, wherein the electrophotographic photoreceptor comprises:

an electroconductive substrate;

a charge generation layer located overlying the electroconductive substrate;

a charge transport layer located overlying the charge generation layer; and a crosslinked charge transport layer, located overlying the charge transport layer, wherein the crosslinked charge transport layer is formed by hardening a radical polymeric monomer having three or more functional groups without a charge transport structure and a radical polymeric compound having one functional group with a charge transporting structure.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
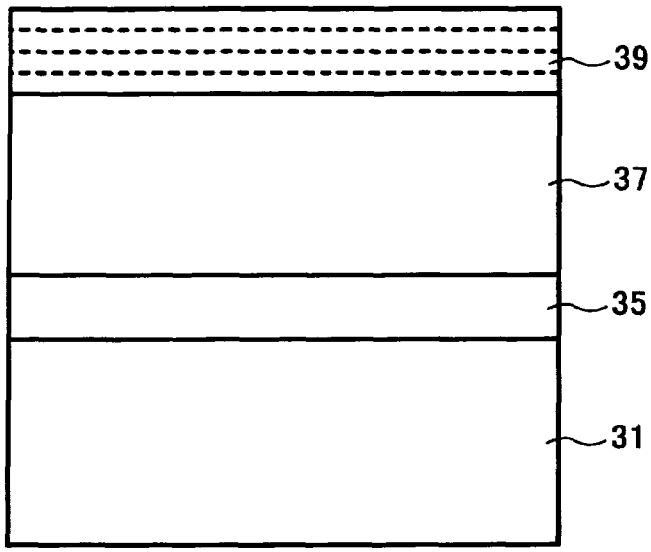
FIG. 1 is a cross-sectional view of an embodiment of a layer composition of the electrophotographic photoreceptor of the present invention.

The present invention provides an electrophotographic image forming apparatus having high durability and producing no abnormal images such as blurred images, wherein ozone and NOx are reduced.

The electrophotographic photoreceptor for use in the present invention will be explained, referring to the drawings.

FIG. 1 is a cross-sectional view of an embodiment of a layer composition of the electrophotographic photoreceptor of the present invention, wherein a charge generation layer (35) is located overlying an electroconductive substrate (31), a charge transport layer (37) is located overlying the charge generation layer (35), and a crosslinked charge transport layer (39) is located overlying the charge transport layer (37).

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate.

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the substrate (31).

The charge transport layer (35) is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the charge generation layer (CGL) (35) include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Laid-Open Patent Publications Nos. 63-285552, 05-19497, 05-70595, 10-73944, etc.

The CGL (35) also can include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the CGL (35) are broadly classified into a vacuum thin film forming method and a solvent dispersion casting method.

Specific examples of the former vacuum thin film forming method include a vacuum evaporation method, a glow discharge decomposition method, anion plating method, a sputtering method, a reaction sputtering method, CVD (chemical vapor deposition) methods, etc. A layer of the above-mentioned inorganic and organic materials can be formed by these methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and more preferably from about 0.05 to about 2 μm.

The charge transport layer (CTL) (37) is a layer having charge transportability, and is formed by dispersing a charge transport material having charge transportability and a binder resin ins proper solvent to prepare a coating liquid; and coating the coating liquid on the CGL (35) and drying the liquid.

Specific examples of the charge transport materials include electron transport materials, positive hole transport materials and charge transport polymer materials used in the CGL (35). Particularly, the charge transport polymer materials are effectively used to reduce a solution of a lower layer when a crosslinked charge transport layer is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyvinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxy resins, melamine resins, urethane resins, phenol resins and alkyd resins.

The CTL (37) preferably include the charge transport material in an amount of from 20 to 300 parts by weight, and more preferably from 40 to 150 parts by weight per 100 parts by weight of the binder resin. However, the charge transport polymer material can be used alone or in combination with the binder resin.

Specific examples of a solvent used for coating the CTL (37) include the solvents used for coating the CGL (35), and particularly the solvents solving the charge transport material and binder resin well are preferably used. These solvents can be used alone or in combination. The CTL (37) can be formed by the same coating methods used for coating the CGL (35).

The CTL (37) may optionally include a plasticizer and a leveling agent.

Specific examples of the plasticizers include plasticizers for typical resins, such as dibutylphthalate and dioctylphthalate, and a content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin.

The CTL (37) preferably has a thickness of from 5 to 40 μm, and more preferably from 10 to 30 μm.

The crosslinked CTL (39) is a layer having a crosslinked structure and charge transportability, and is formed by dissolving or dispersing a radical polymeric monomer having three or more functional groups without a charge transport structure and a radical polymeric compound having one functional group with a charge transporting structure in a proper solvent to prepare a coating liquid; and coating the coating liquid on the CTL (37) and drying the liquid.

Constituents for a coating liquid for the crosslinked CTL (39) of the present invention will be explained.

The radical polymeric monomer having three or more functional groups without a charge transporting structure for use in the present invention represents a monomer which has neither a positive hole transport structure such as triarylamine, hydrazone, pyrazoline and carbazole nor an electron transport structure such as condensed polycyclic quinone, diphenoquinone, a cyano group and an electron attractive aromatic ring having a nitro group, and has three or more radical polymeric functional groups. Any radical polymeric functional groups can be used, provided they have a carbon-carbon double bonding and capable of radically polymeric. Specific examples of the radical polymeric functional groups include the following 1-substituted ethylene functional groups and 1,1-substituted ethylene functional groups.

Specific examples of the 1-substituted ethylene functional groups include functional groups having the following formula (10):

$$CH_2{=}CH{-}X_1{-} \tag{10}$$

wherein $X_1$ represents a substituted or an unsubstituted phenylene group, an arylene group such as a naphthylene group, a substituted or an unsubstituted alkenylene group, a —CO-group, a —COO-group and a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula (11):

$$CH_2{=}CH(Y){-}X_2{-} \tag{11}$$

wherein $Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group wherein $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_2$ represents a substituted or an unsubstituted phenylene group, an arylene group such as a naphthylene group, a substituted or an unsubstituted alkenylene group, a —CO-group, a —COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc.

Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups.

Among these radical polymeric function groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymeric function groups in a monomer having three or more radical polymeric function groups may be the same or different from one another.

Specific examples of the radical polymeric monomer having three or more functional groups without a charge transporting structure include the following materials, but which are not limited thereto.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymeric monomer having three or more functional groups without a charge transporting structure for use in the present invention preferably has a ratio of the molecular weight to the number of functional groups (molecular weight/number of functional groups) in the monomer not greater than 250. When the ratio is greater than 250, the resultant crosslinked CTL has a rather lowered abrasion resistance, and it is not preferable to use the HPA, EO and PO-modified monomers having extremely long modified groups.

The crosslinked CTL preferably includes the radical polymeric monomer having three or more functional groups without a charge transporting structure in an amount of from 20 to 80% by weight, and more preferably from 30 to 70% by weight. When less than 20% by weight, a three-dimensional crosslinked bonding density of the crosslinked CTL is insufficient, and the abrasion resistance thereof does not remarkably improve more than a layer including a conventional thermoplastic resin. When greater than 80% by weight, a content of a charge transporting compound lowers and electrical properties of the resultant photoreceptor deteriorates. Although it depends on a required abrasion resistance and electrical properties, in consideration of a balance therebetween, a content of the radical polymeric monomer having three or more functional groups without a charge transporting structure is most preferably from 30 to 70% by weight based on total weight of the crosslinked CTL.

The radical polymeric compound having one functional group with a charge transporting structure for use in the crosslinked CTL (39) of the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymeric functional group. Specific examples of the radical polymeric functional group include the above-mentioned radical polymeric monomers, and particularly the acryloyloxy groups and methacryloyloxy groups are effectively used. In addition, a triarylamine structure is effectively used as the charge transport structure. Further, when a compound having the following formula (1) or (2), electrical properties such as a sensitivity and a residual potential are preferably maintained.

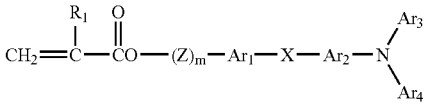

(1)

-continued

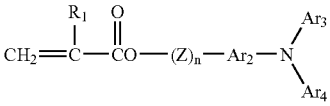

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom or a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

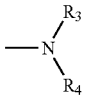

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc. The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol, and the alkylene group of the alkyleneether group may include a substituent such as a hydroxyl group, a methyl group and an ethyl group.

The vinylene group has the following formula:

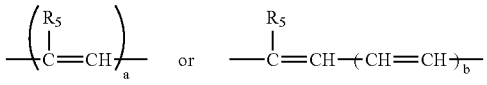

wherein $R_5$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a divalent substituted or an unsubstituted alkyleneether group and alkyleneoxycarbonyl group.

Specific examples of the substituted or unsubstituted alkylene group include those of X.

Specific examples of the divalent substituted or unsubstituted alkyleneether group include those of X.

Specific examples of the divalent alkyleneoxycarbonyl group include a divalent caprolactone-modified group. In addition, the radical polymeric compound having one functional group with a charge transporting structure of the present invention is more preferably a compound having the following formula (3):

(3)

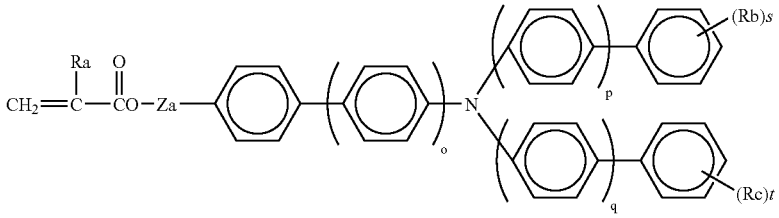

wherein o, p and q independently represent 0 or 1; Ra represents a hydrogen atom or a methyl group; Rb and Rc represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

—$CH_2CH_2O$—,

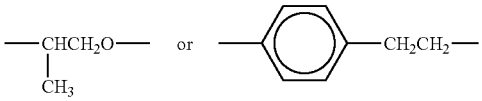

The compound having formula (3) are preferably a compound having an methyl group or a ethyl group as a substituent of Rb and Rc.

The radical polymeric compound having one functional group with a charge transporting structure of the formulae (1), (2) and particularly (3) for use in the present invention does not become an end structure because a double bonding between the carbons is polymerized while opened to the both sides, and is built in a chain polymer. In a crosslinked polymer polymerized with a radical polymeric monomer having three or more functional groups, the compound is present in a main chain and in a crosslinked chain between the main chains (the crosslinked chain includes an intermolecular crosslinked chain between a polymer and another polymer and an intramolecular crosslinked chain where in a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the radical polymeric compound having one functional group with a charge transporting structure in a surface layer of an electrophotographic photoreceptor can have an intramolecular structure wherein blocking of a charge transport route is comparatively prevented.

Specific examples of the radical polymeric compound having one functional group with a charge transporting structure include compounds having the following formulae, but the compounds are not limited thereto.

TABLE 1-1

No. 1

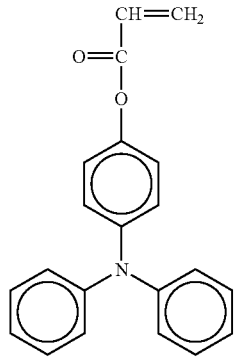

No. 2

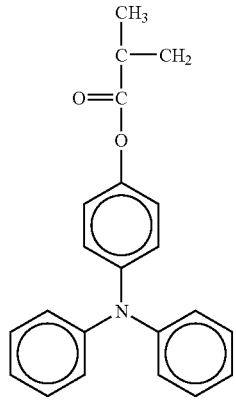

No. 3

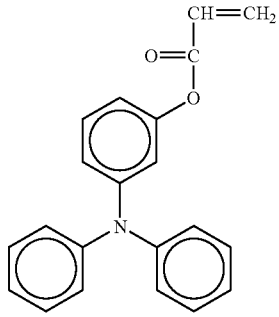

TABLE 1-1-continued
No. 4
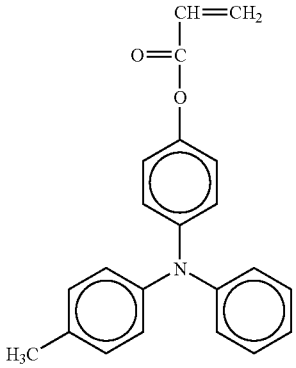
No. 5
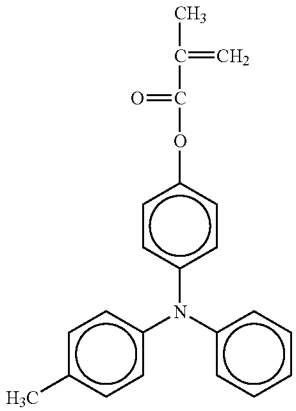
No. 6
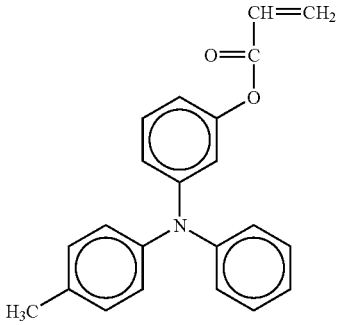
No. 7
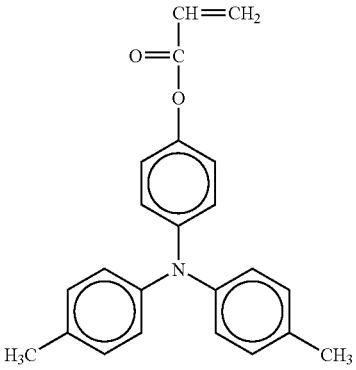
TABLE 1-1-continued
No. 8
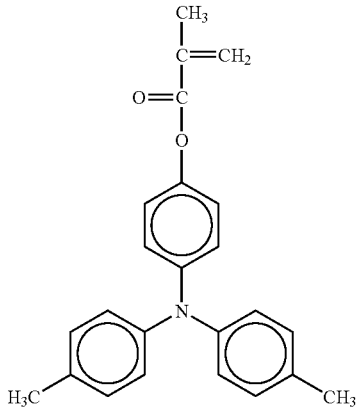
No. 9
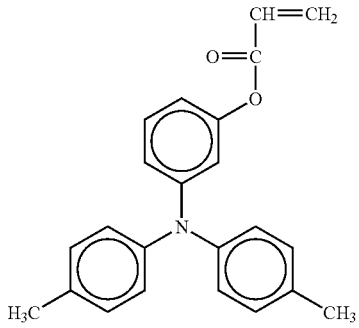
No. 10
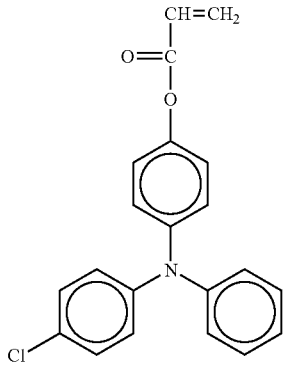
No. 11
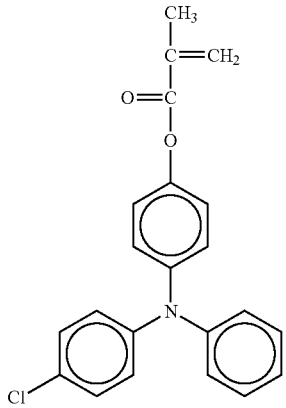

TABLE 1-1-continued
No. 12
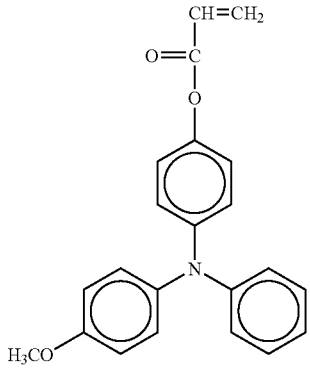
No. 13
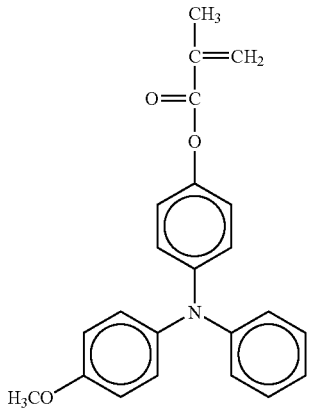
No. 14
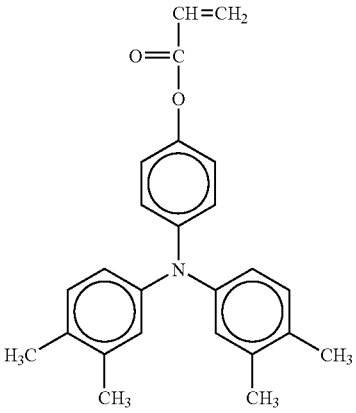
No. 15
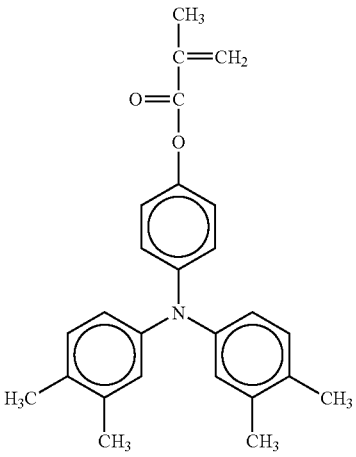
TABLE 1-1-continued
No. 16
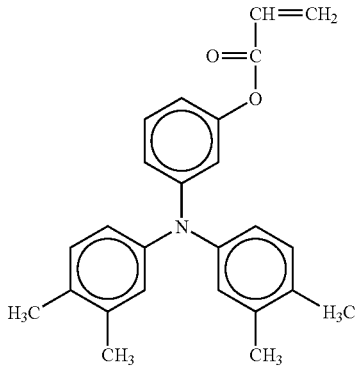
TABLE 1-2
No. 17
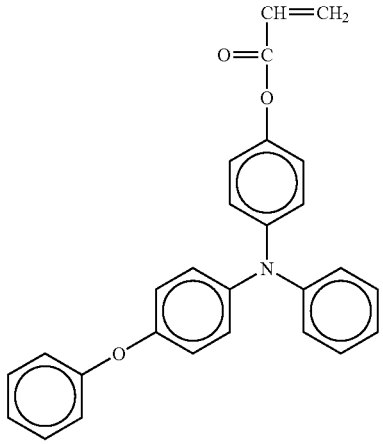
No. 18
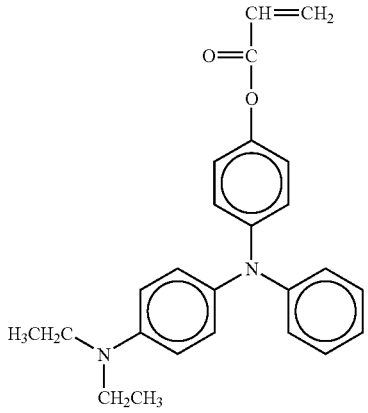

TABLE 1-2-continued
No. 19
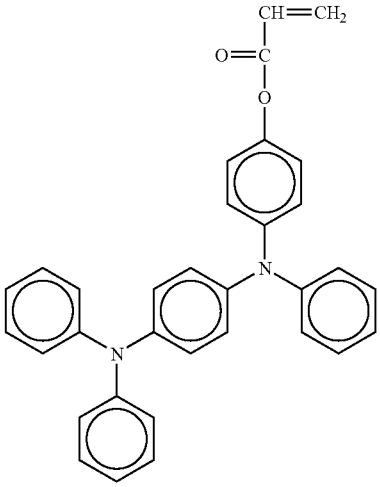
No. 20
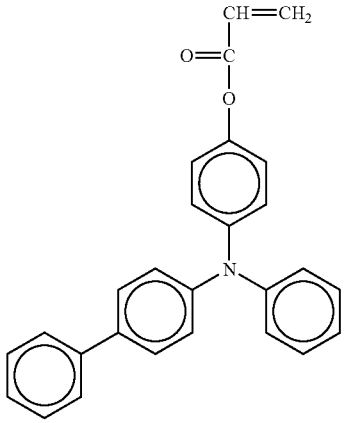
No. 21
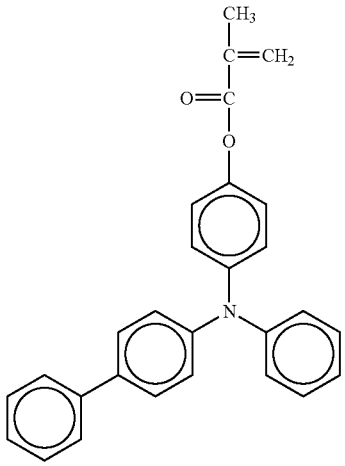
TABLE 1-2-continued
No. 22
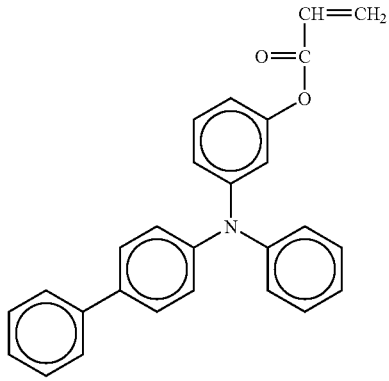
No. 23
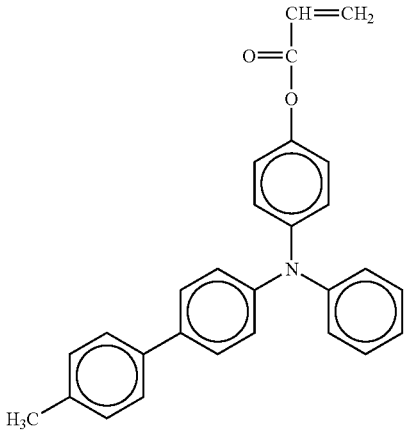
No. 24
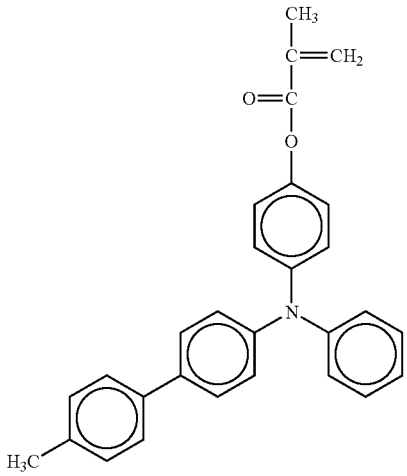

TABLE 1-2-continued
No. 25
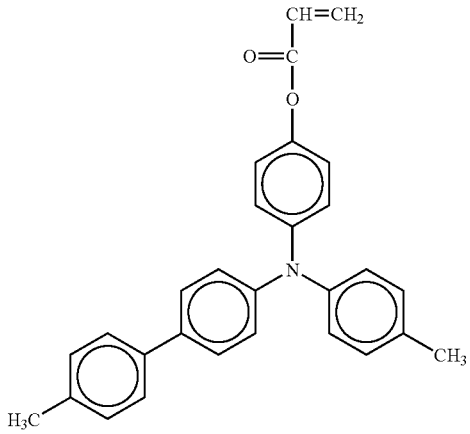
No. 26
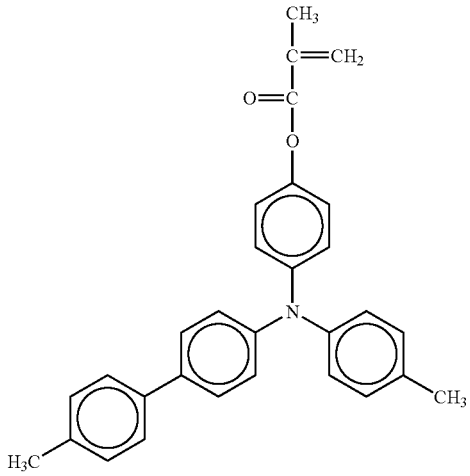
No. 27
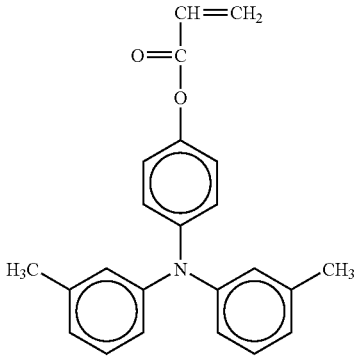
TABLE 1-2-continued
No. 28
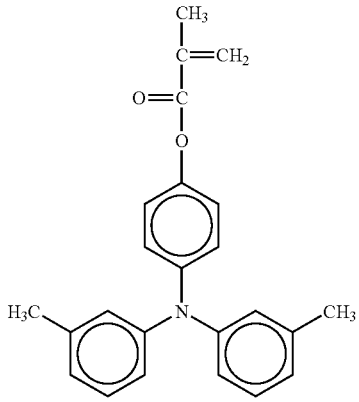
No. 29
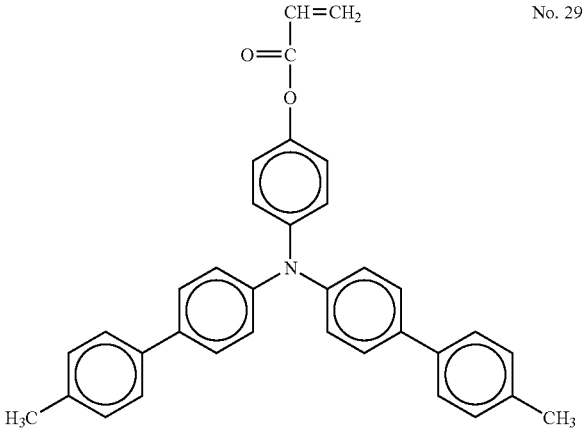
No. 30
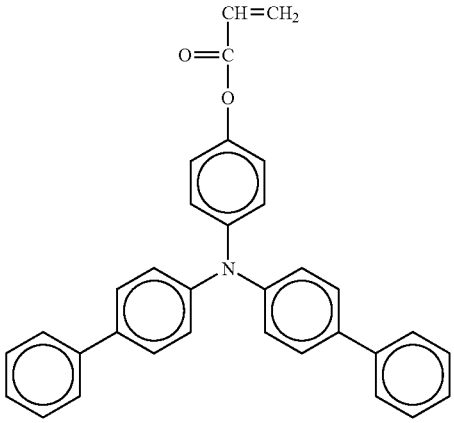
No. 31
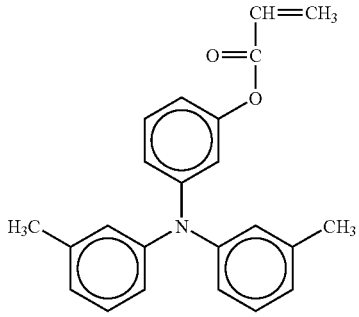

TABLE 1-2-continued
No. 32
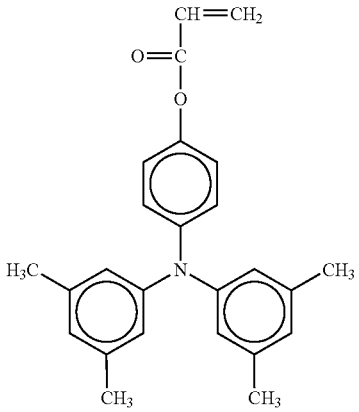
TABLE 1-3
No. 33
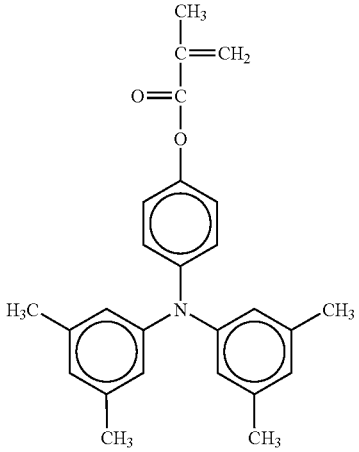
No. 34
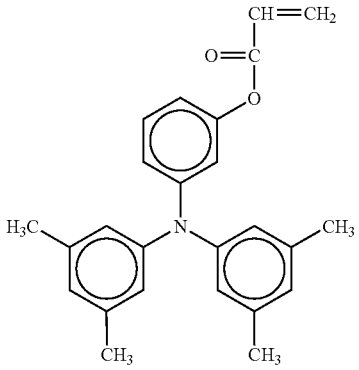
TABLE 1-3-continued
No. 35
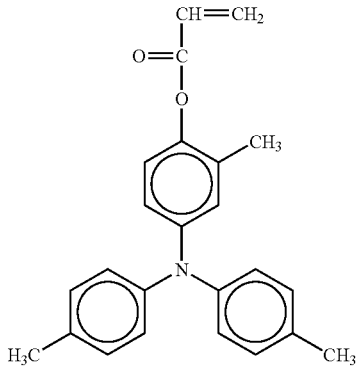
No. 36
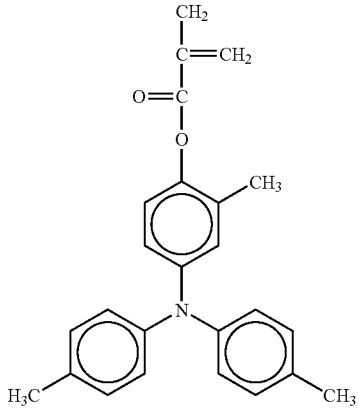
No. 37
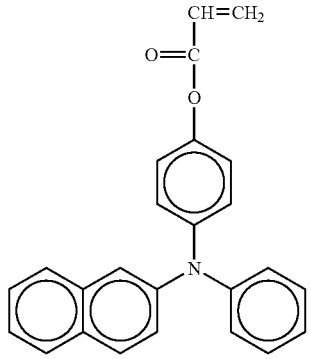
No. 38
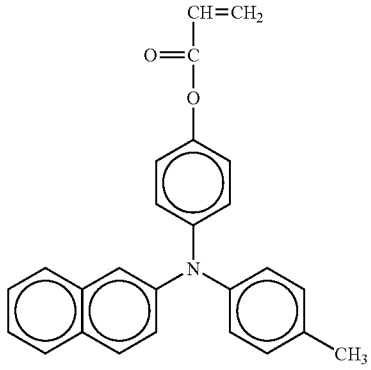

TABLE 1-3-continued
No. 39
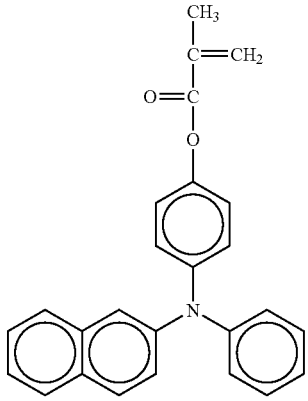
No. 40
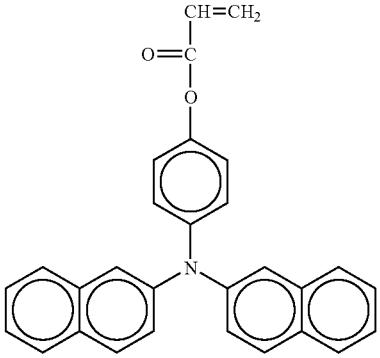
No. 41
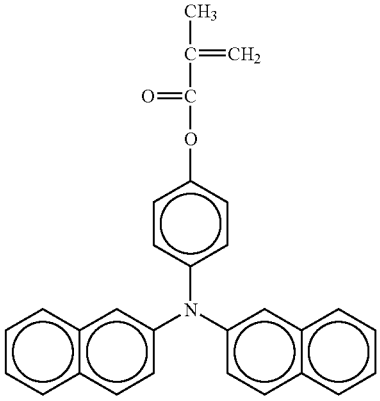
TABLE 1-3-continued
No. 42
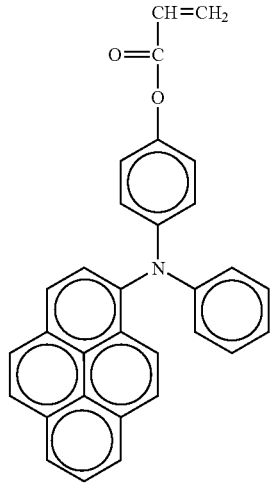
No. 43
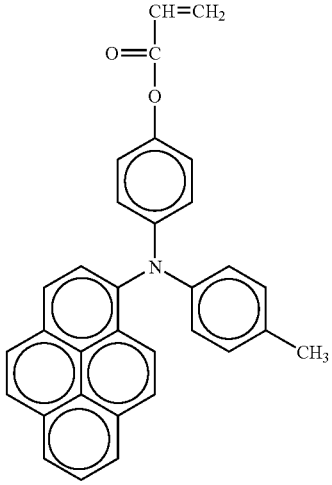
No. 44
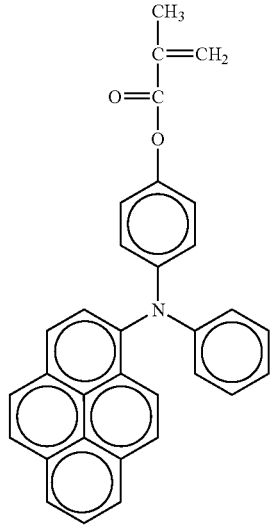

TABLE 1-3-continued
No. 45
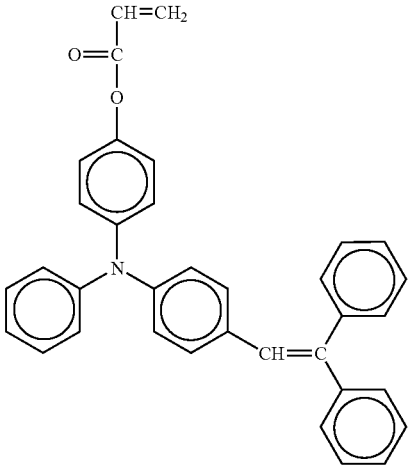
No. 46
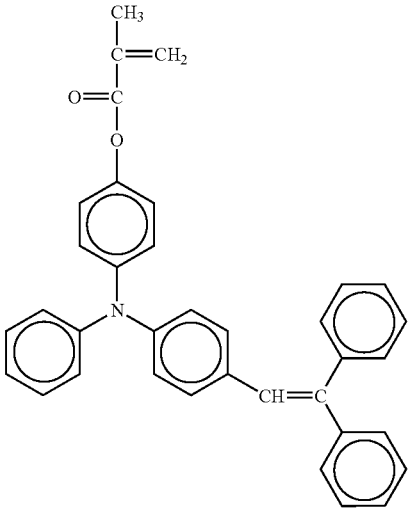
No. 47
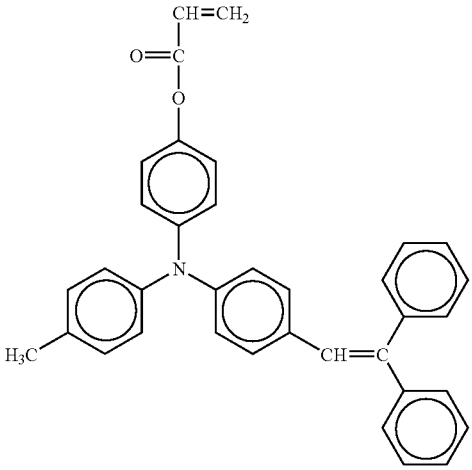
TABLE 1-3-continued
No. 48
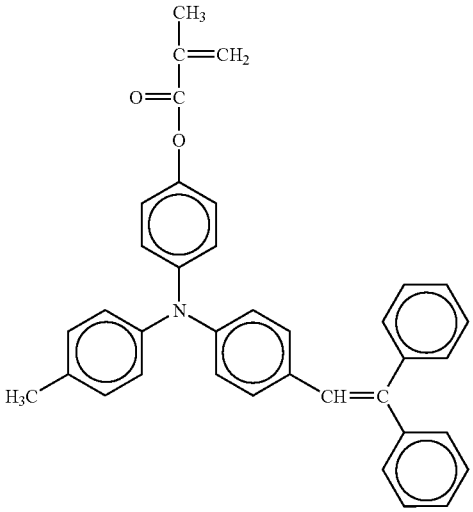
TABLE 1-4
No. 49
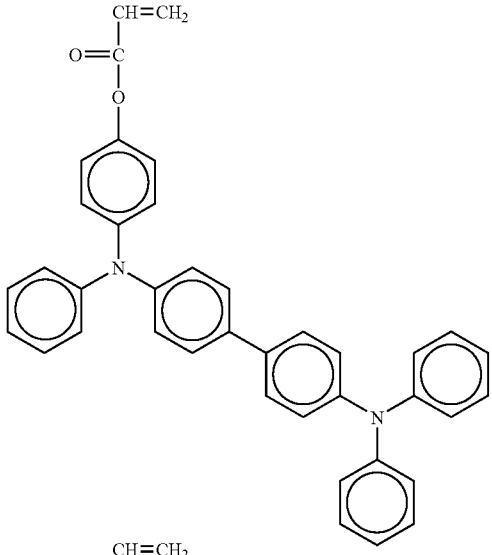
No. 50
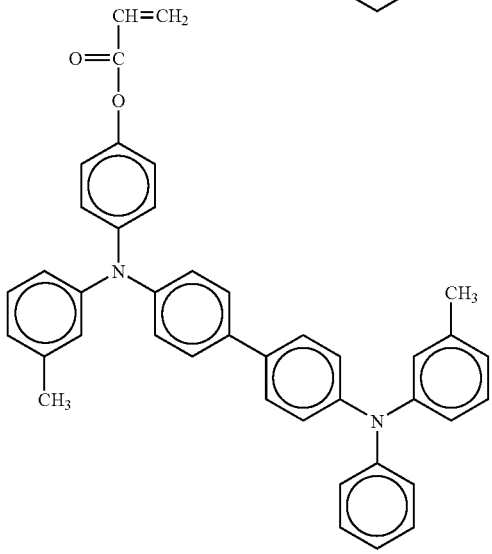

TABLE 1-4-continued
No. 51
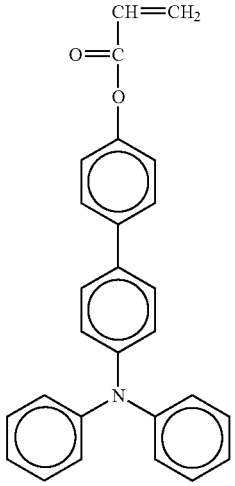
No. 52
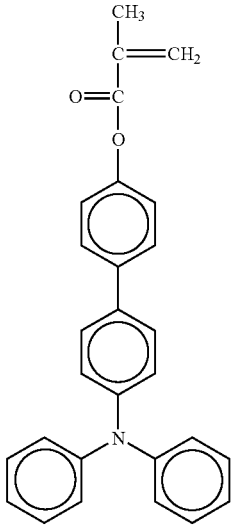
No. 53
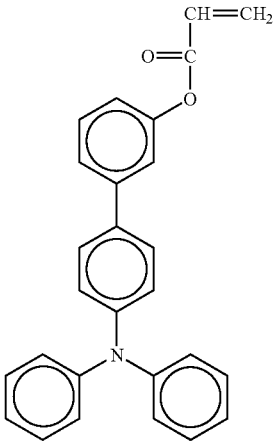
TABLE 1-4-continued
No. 54
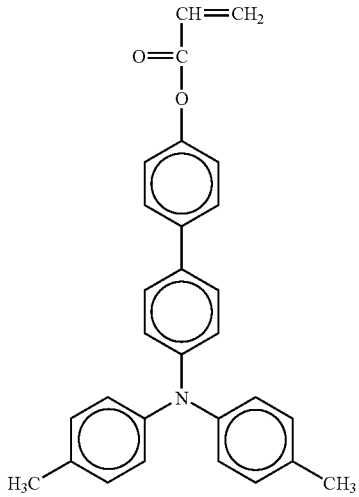
No. 55
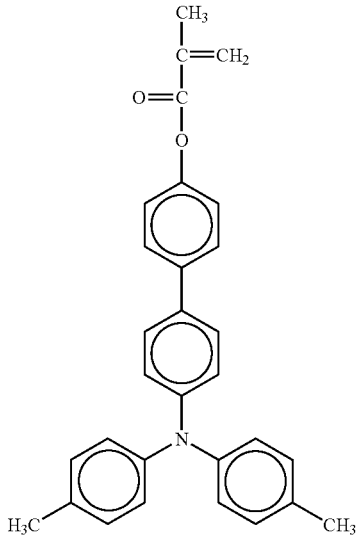
No. 56
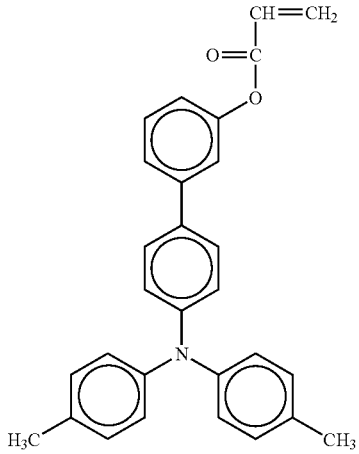

TABLE 1-4-continued
No. 57
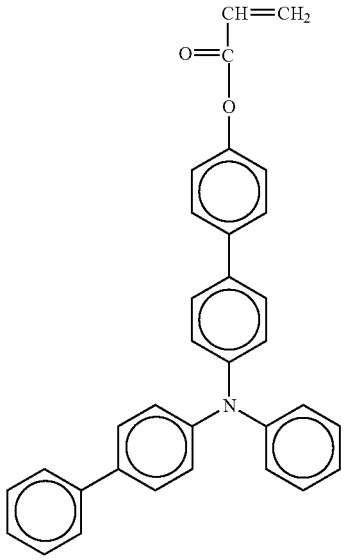
No. 58
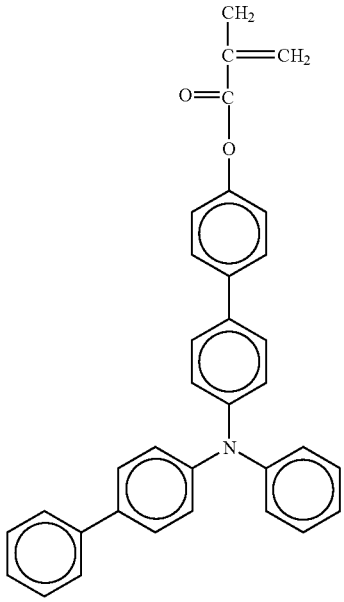
TABLE 1-4-continued
No. 59
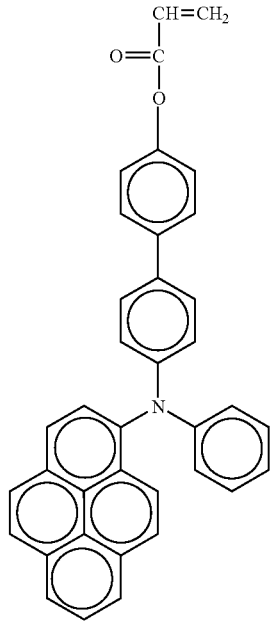
No. 60
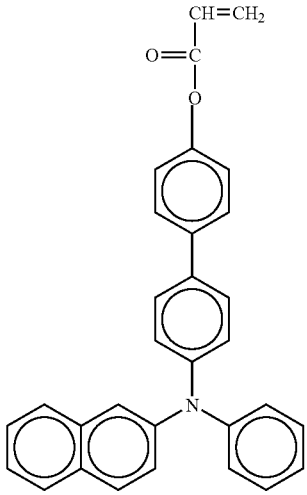

TABLE 1-5
No. 61
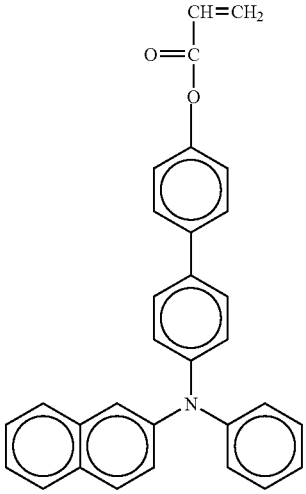
No. 62
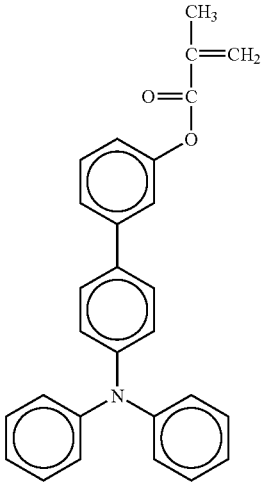
No. 63
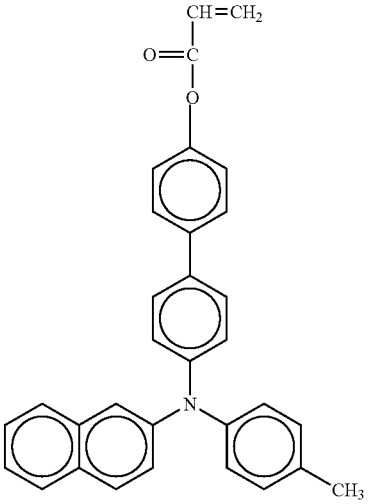
TABLE 1-5-continued
No. 64
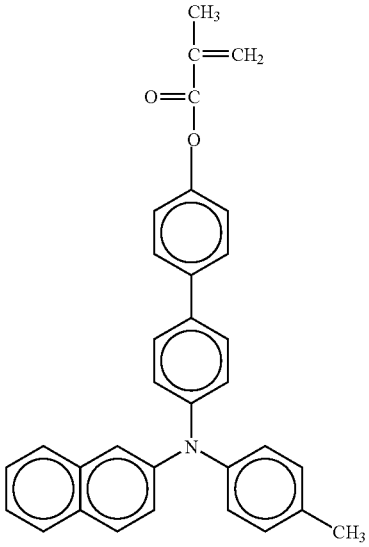
No. 65
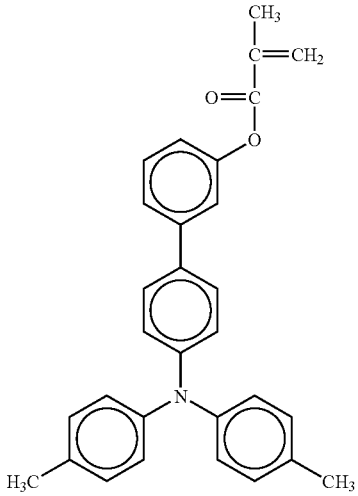
No. 66
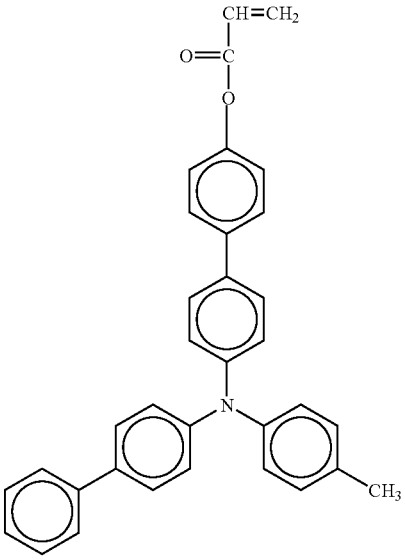

TABLE 1-5-continued
No. 67
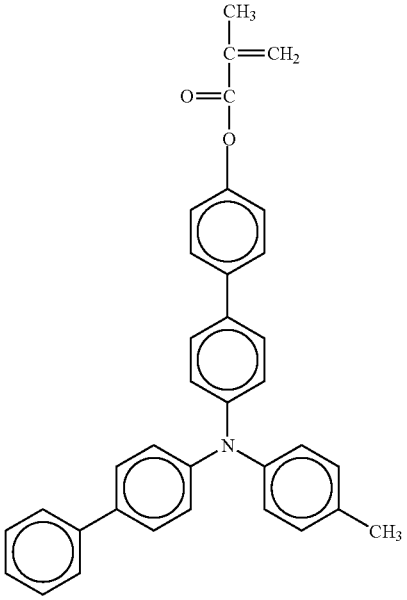
No. 68
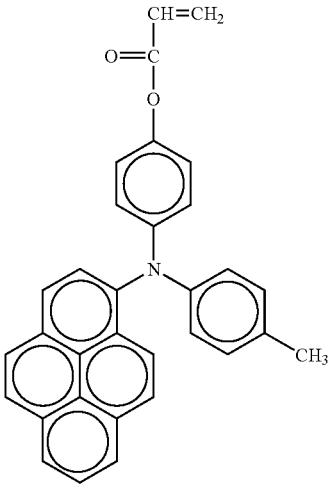
No. 69
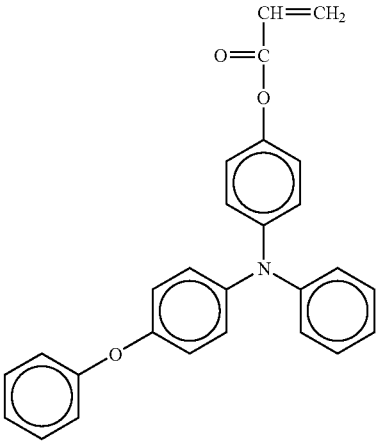
TABLE 1-5-continued
No. 70
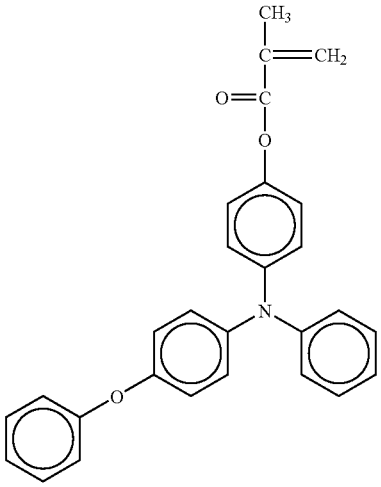
No. 71
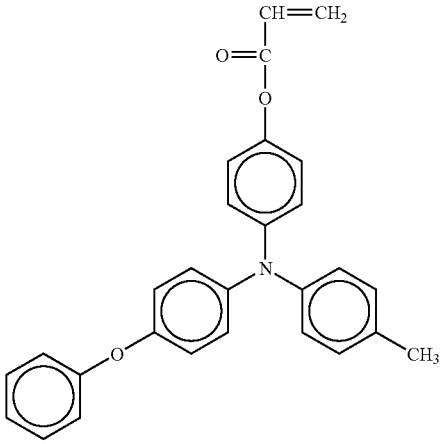
No. 72
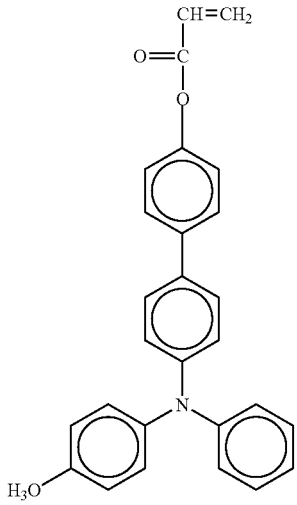

TABLE 1-6
No. 73
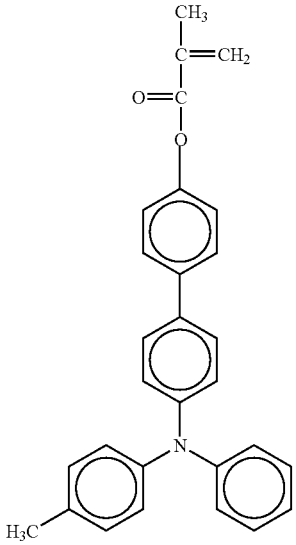
No. 74
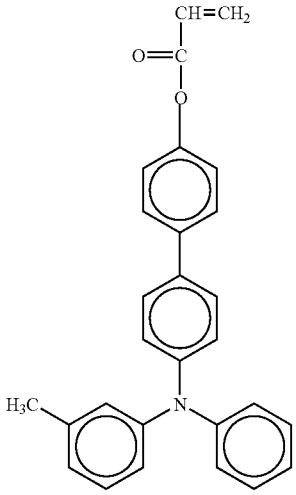
No. 75
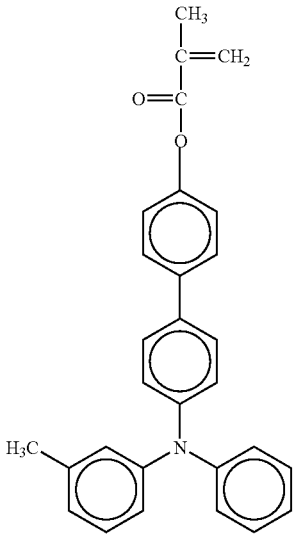
TABLE 1-6-continued
No. 76
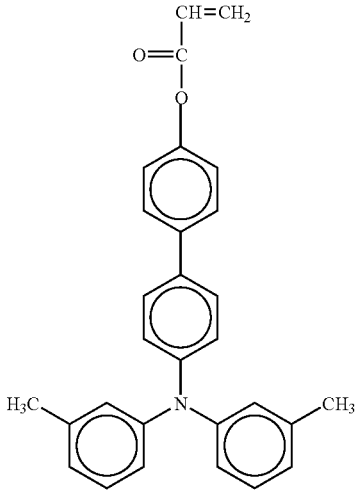
No. 77
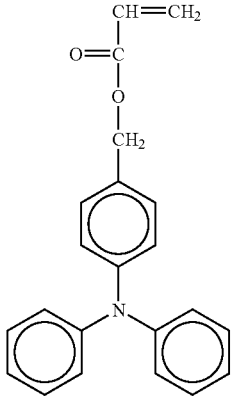
No. 78
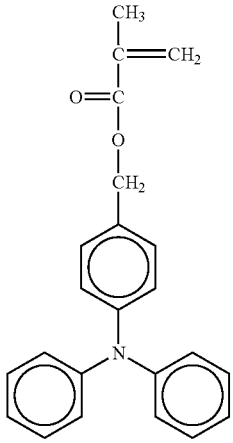

TABLE 1-6-continued
No. 79
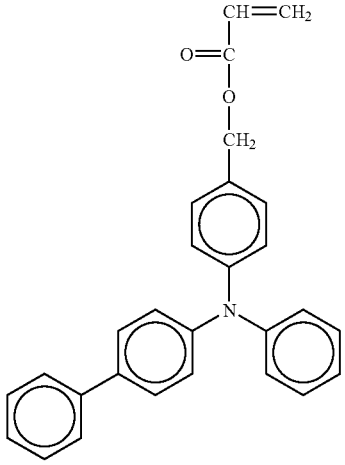
No. 80
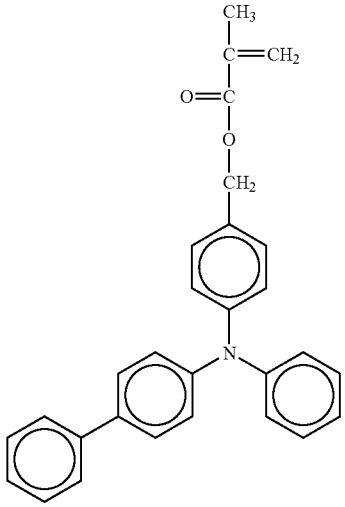
No. 81
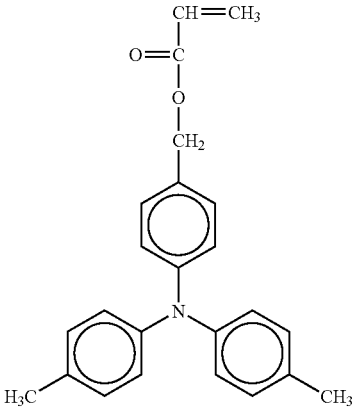
TABLE 1-6-continued
No. 82
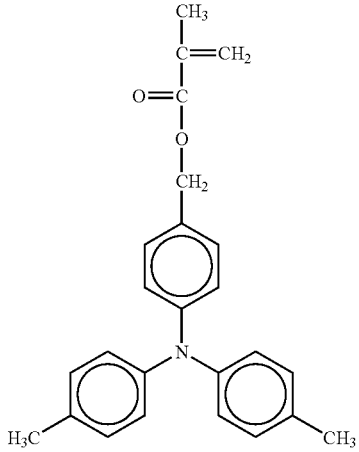
No. 83
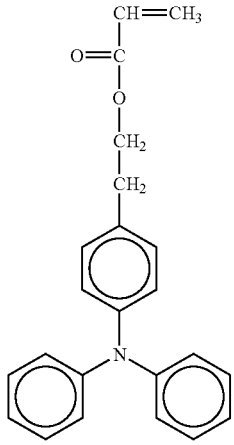
No. 84
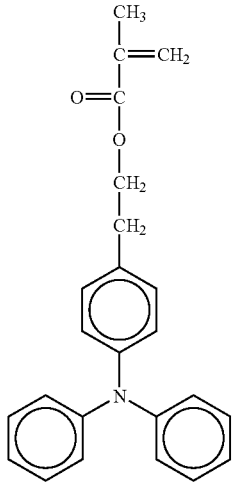

TABLE 1-6-continued
No. 85
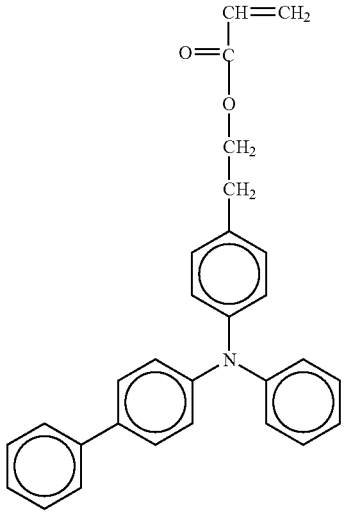
No. 86
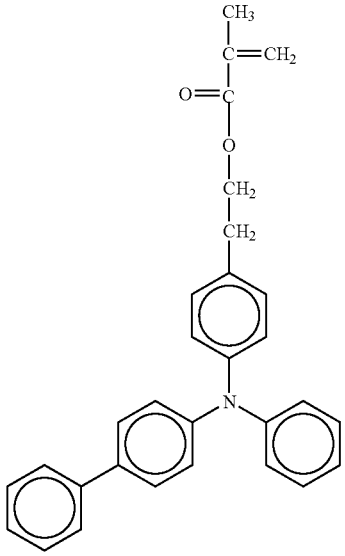
No. 87
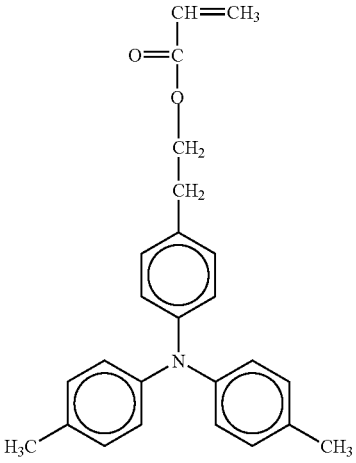
TABLE 1-6-continued
No. 88
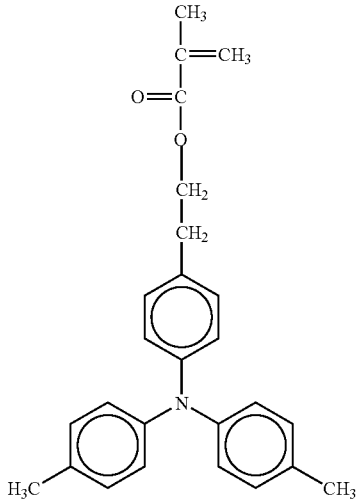
TABLE 1-7
No.89
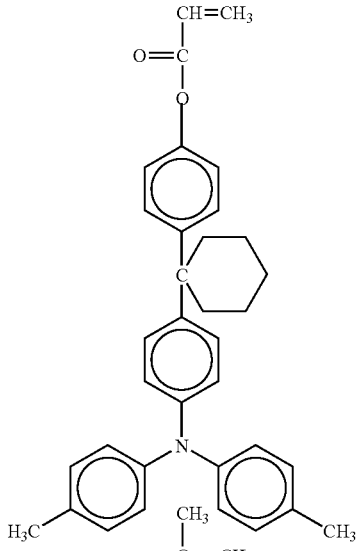
No. 90
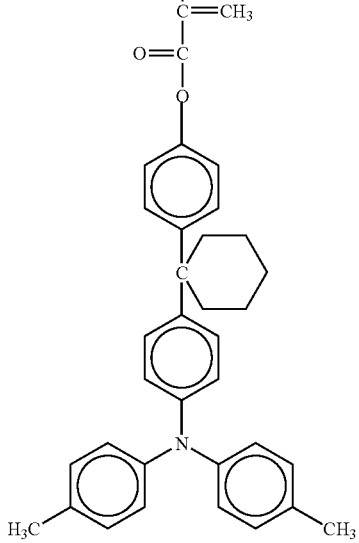

TABLE 1-7-continued
No. 91
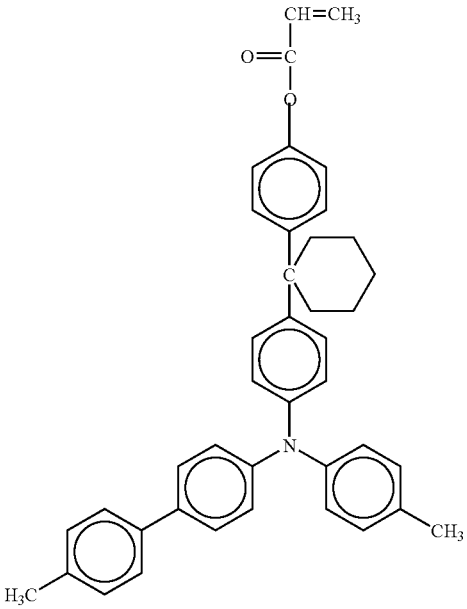
No. 92
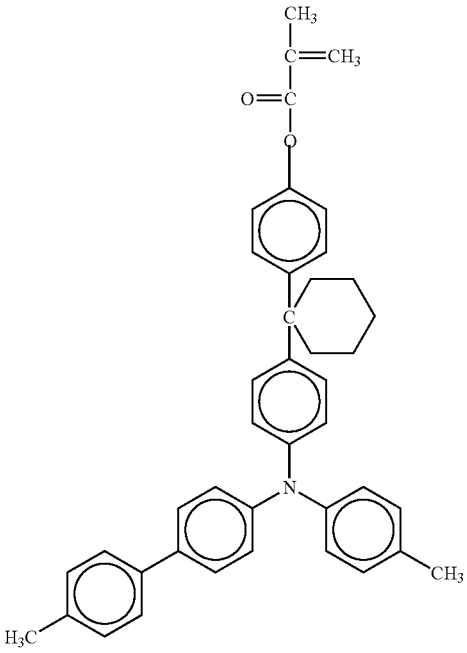
TABLE 1-7-continued
No. 93
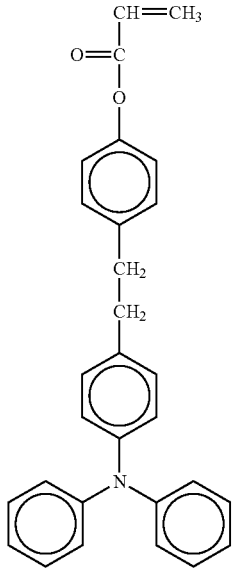
No. 94
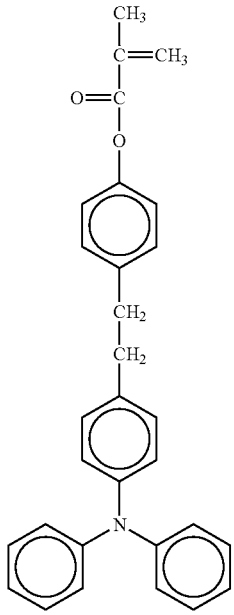

TABLE 1-7-continued
No. 95
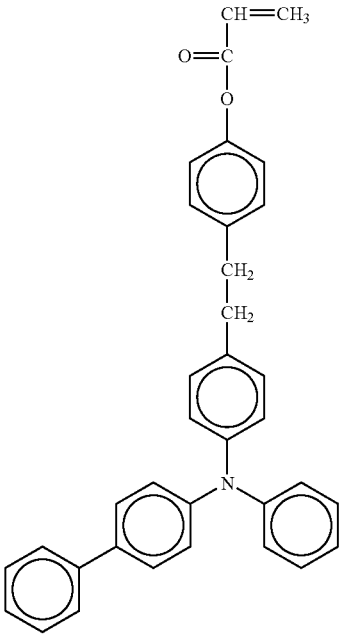
No. 96
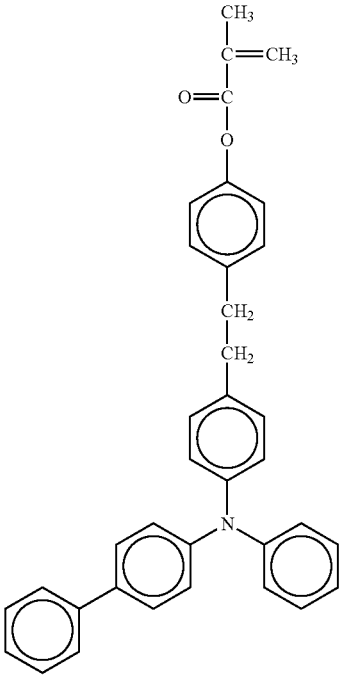
TABLE 1-7-continued
No. 97
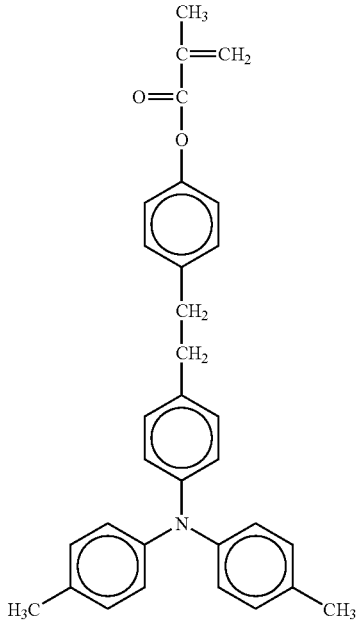
No. 98
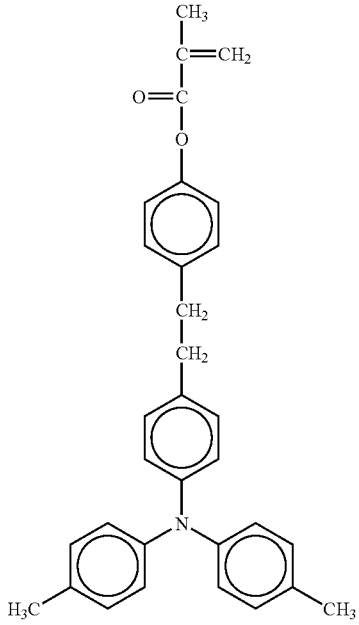

TABLE 1-7-continued
No. 99
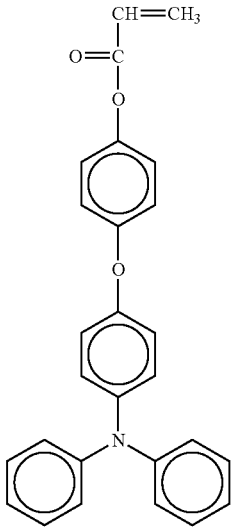
No. 100
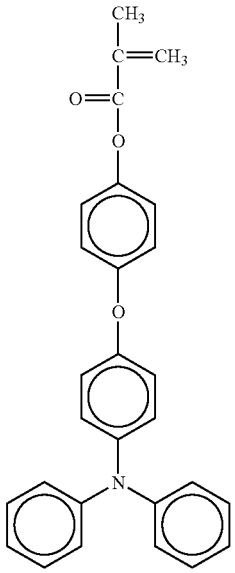
TABLE 1-8
No. 101
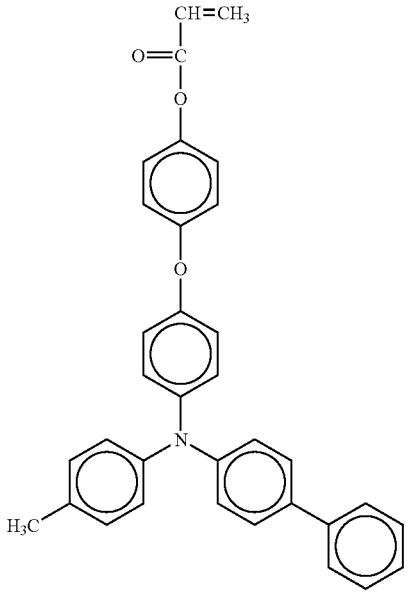
No. 102
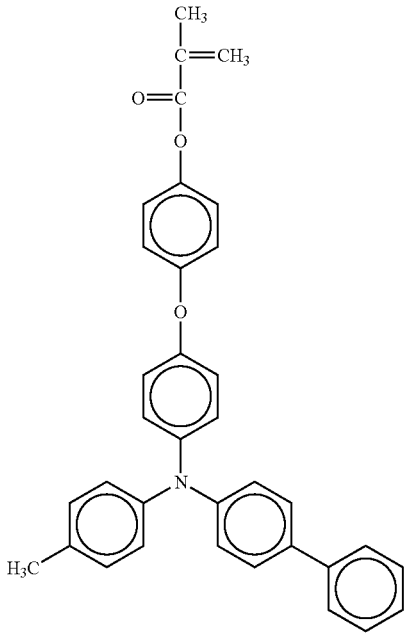

TABLE 1-8-continued
No. 103
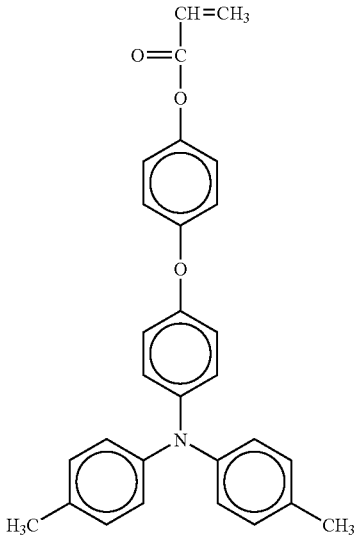
No. 104
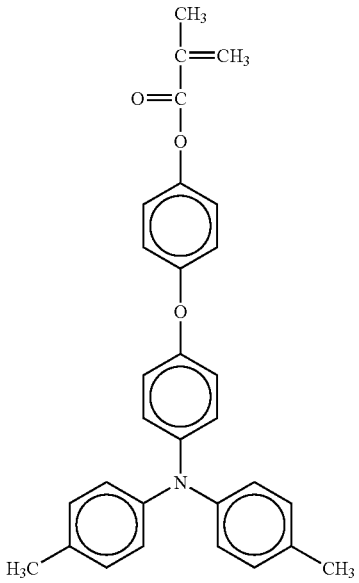
TABLE 1-8-continued
No. 105
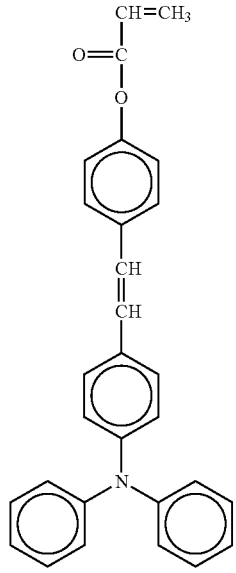
No. 106
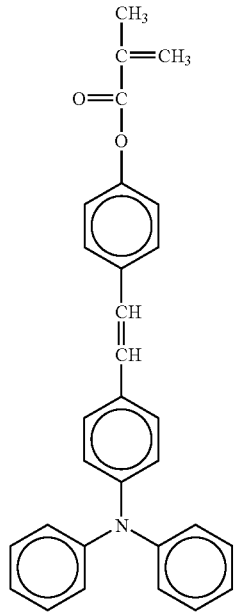

TABLE 1-8-continued
No. 107
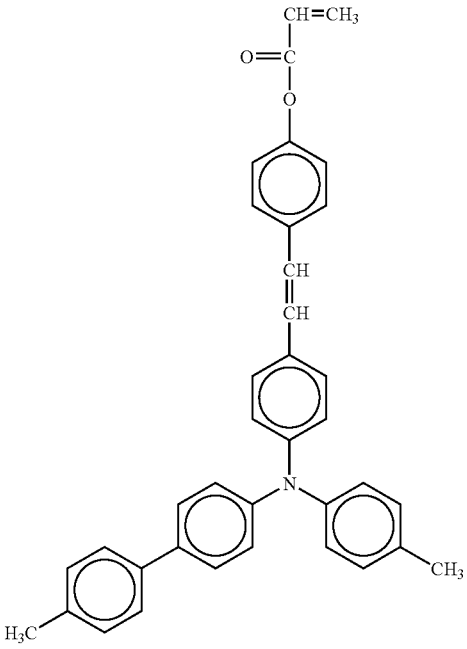
No. 108
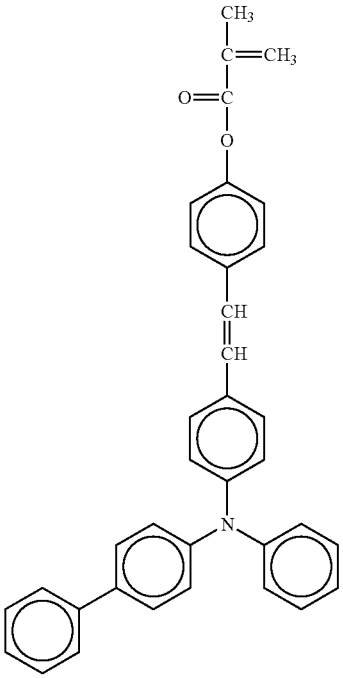
TABLE 1-8-continued
No. 109
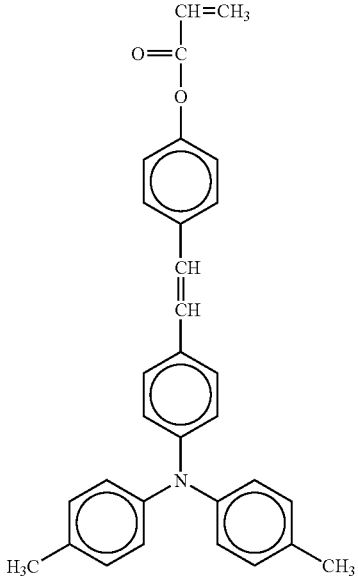
No. 110
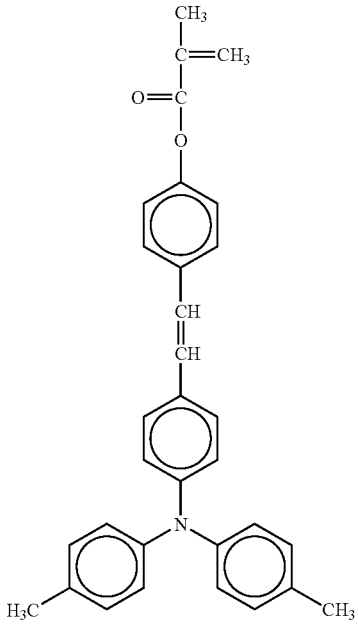

TABLE 1-8-continued
No. 111
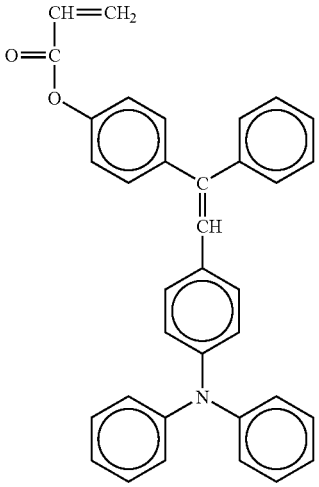
No. 112
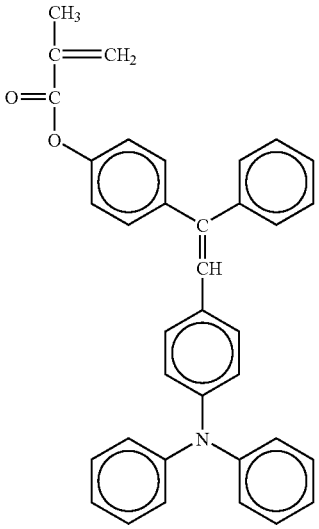
TABLE 1-9
No. 113
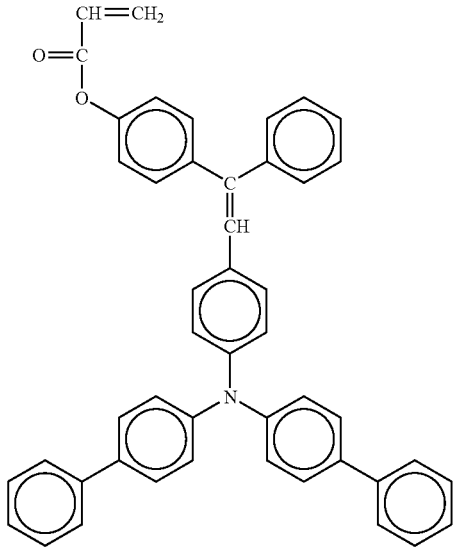
No. 114
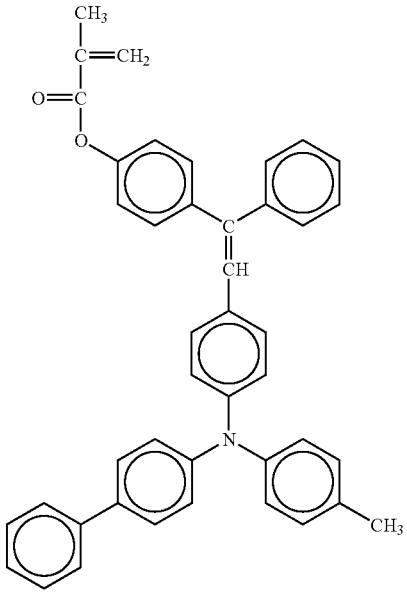
No. 115
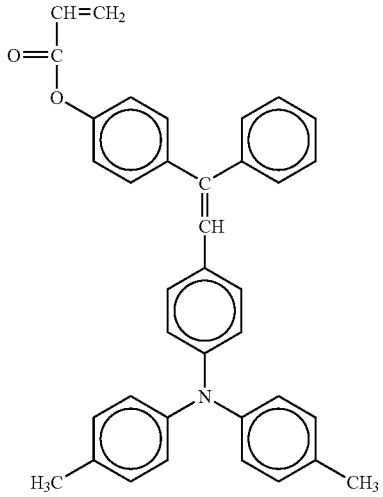

TABLE 1-9-continued
No. 116
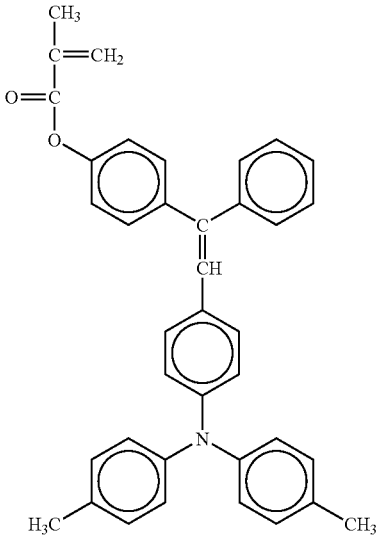
No. 117
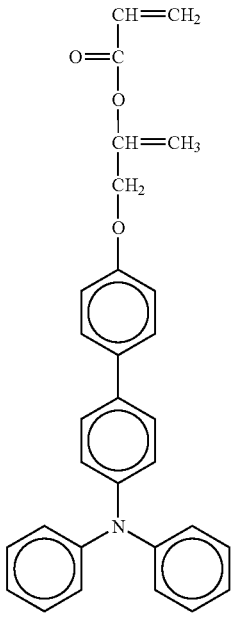
TABLE 1-9-continued
No. 118
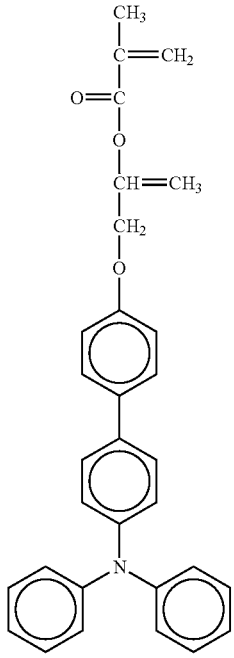
No. 119
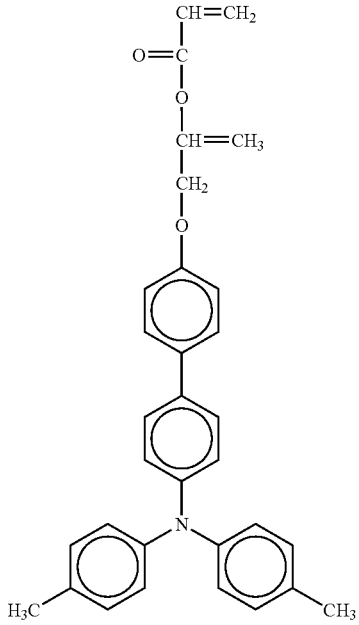

TABLE 1-9-continued
No. 120
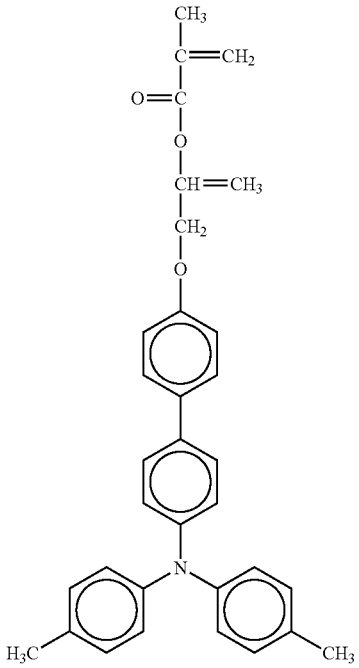
No. 121
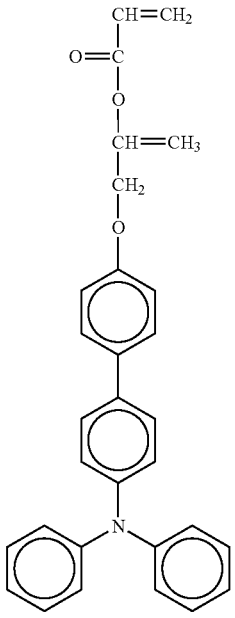
TABLE 1-9-continued
No. 122
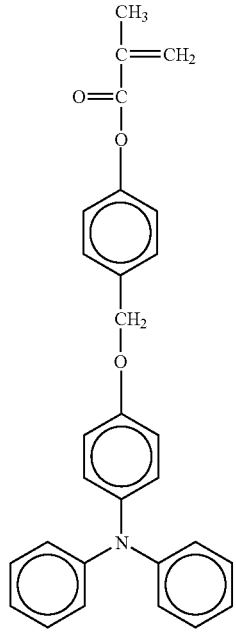
No. 123
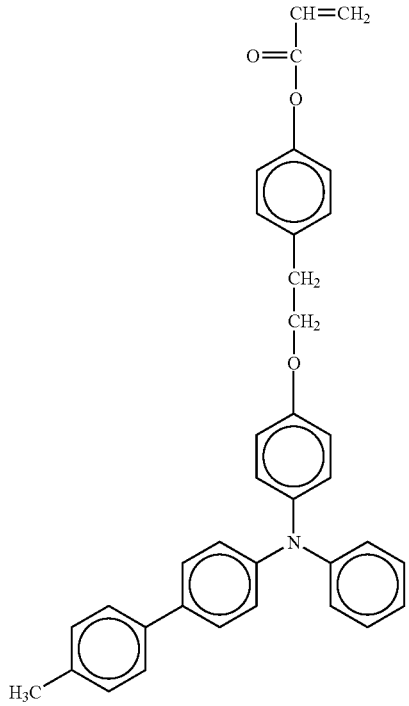
No. 124

TABLE 1-11
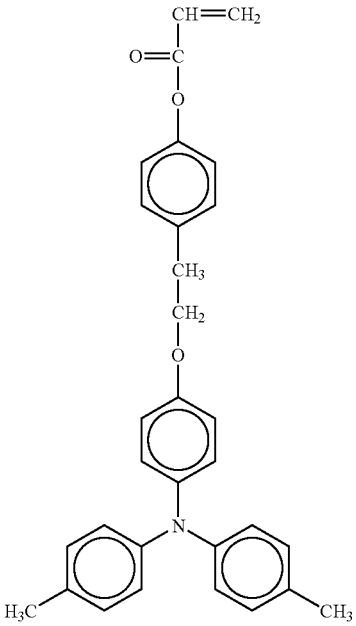
No. 125
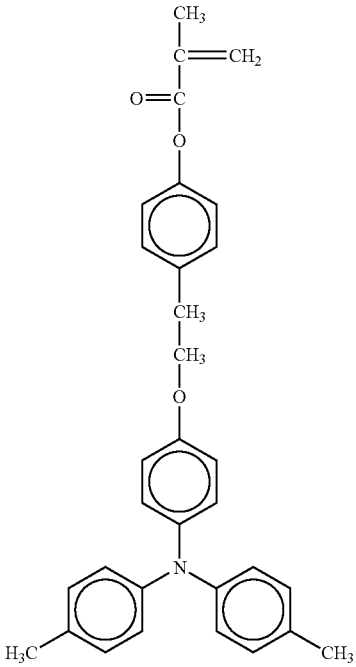
No. 126
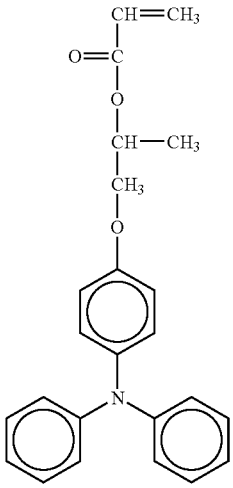
No. 127
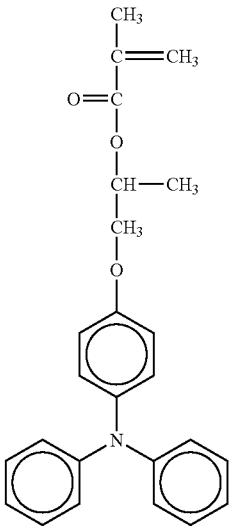
No. 128

TABLE 1-11-continued
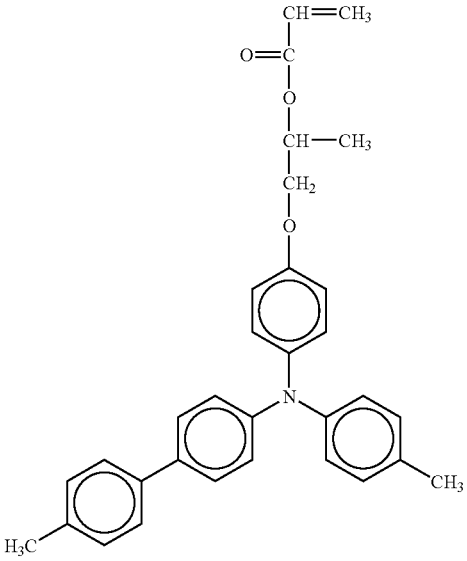
No. 129
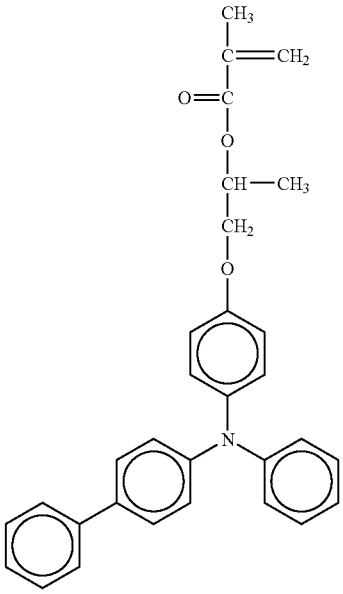
No. 130
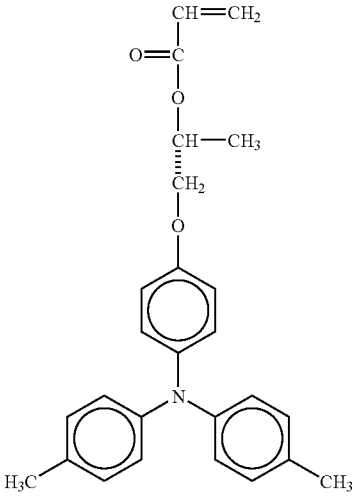
No. 131
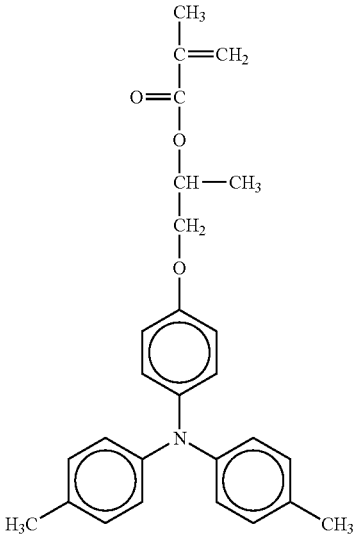
No. 132
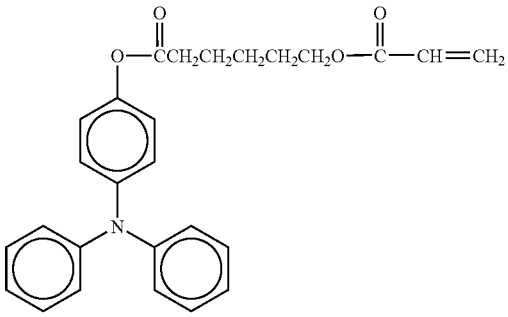
No. 133

TABLE 1-11-continued
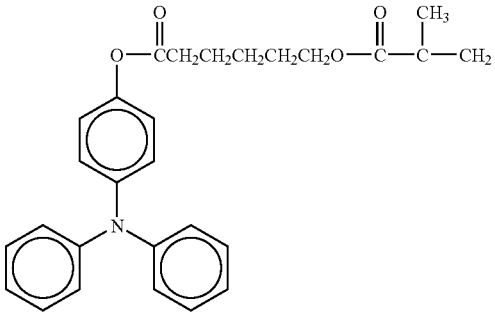
No. 134
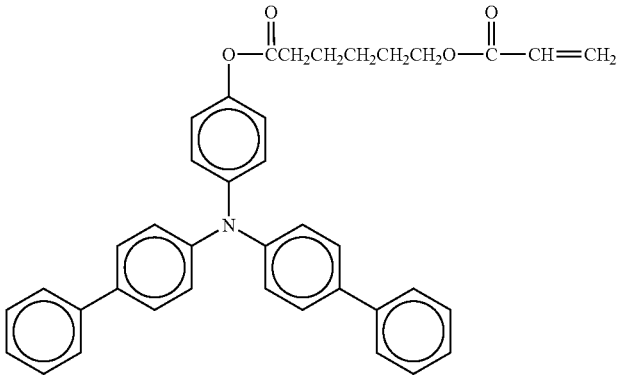
No. 135
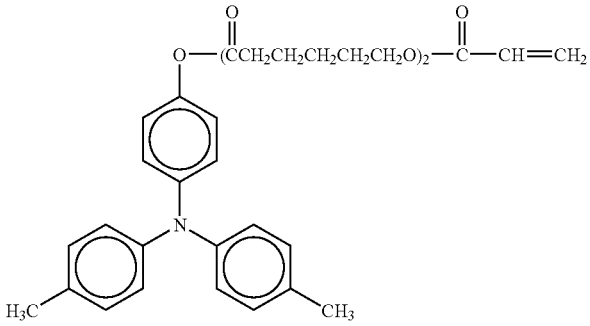
No. 136

TABLE 1-12
No. 137
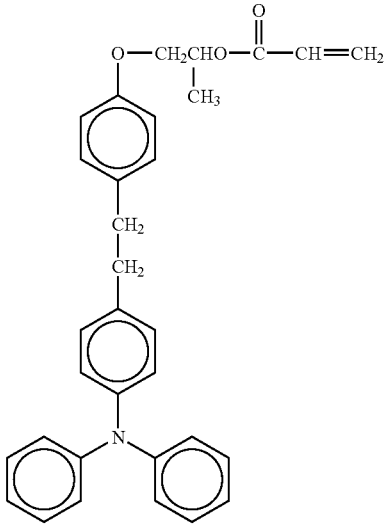
No. 138
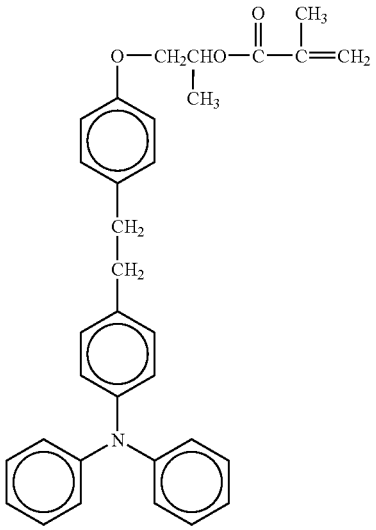
No. 139
TABLE 1-12-continued
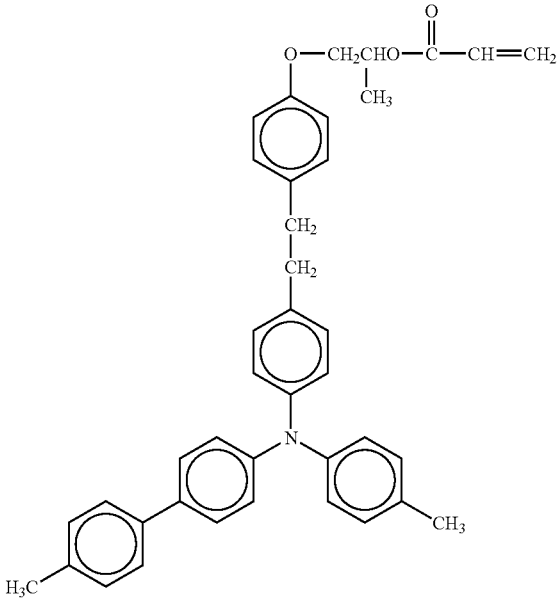
No. 140
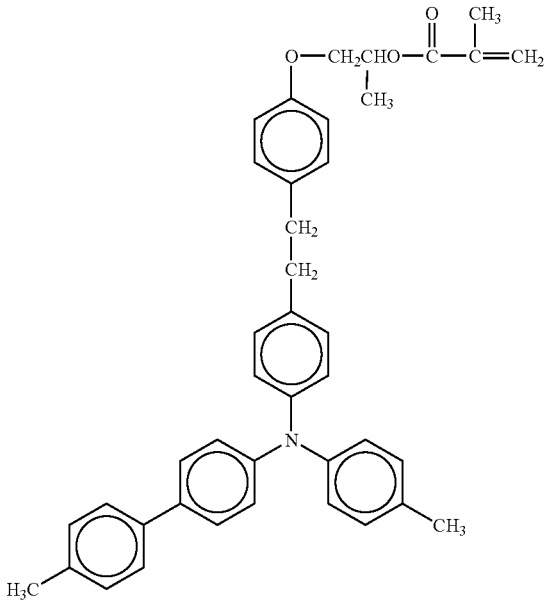
No. 141

TABLE 1-12-continued
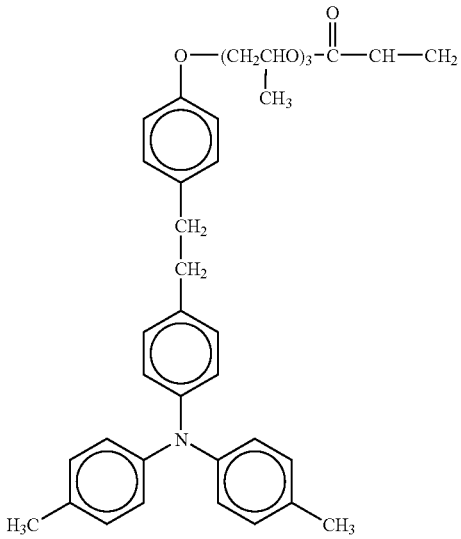
No. 142
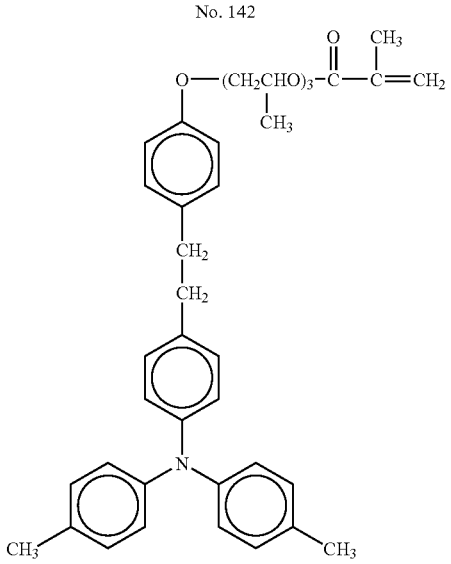
No. 143
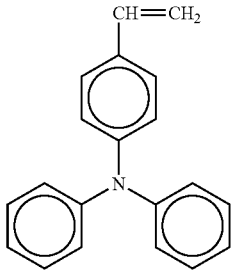
No. 144
TABLE 1-12-continued
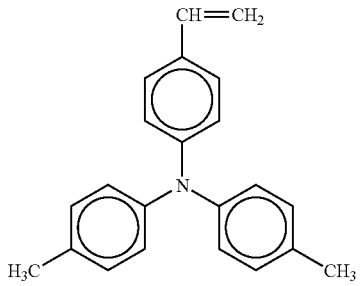
No. 145
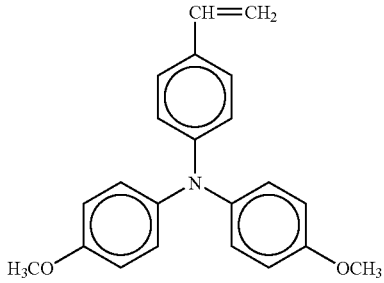
No. 146
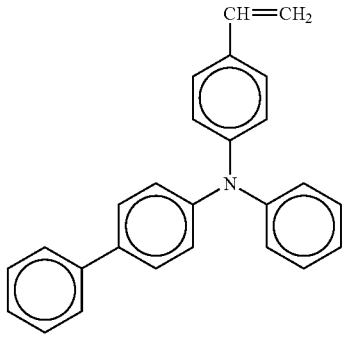
No. 147
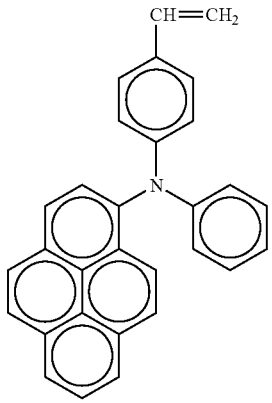
No. 148

TABLE 1-12-continued
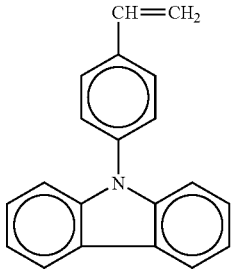
No. 149
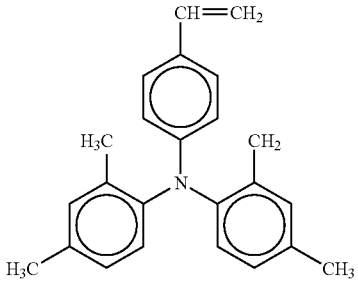
No. 150
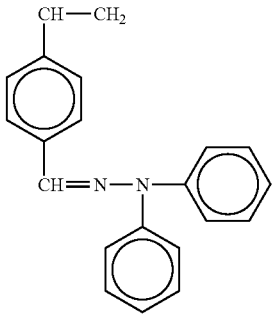
No. 151
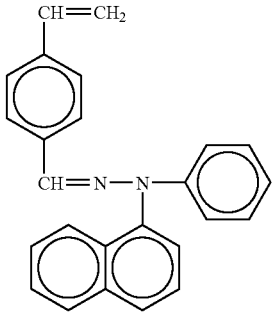
No. 152
-continued
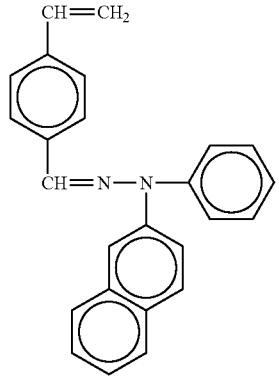
No. 153
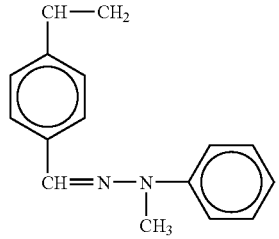
No. 154
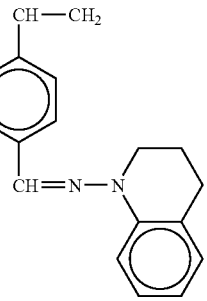
No. 155
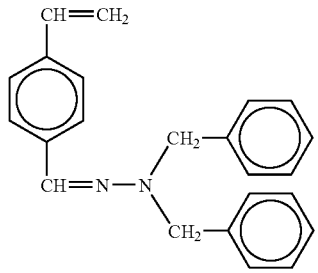
No. 156
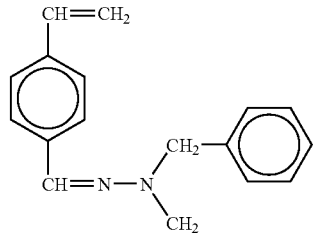
No. 157

-continued

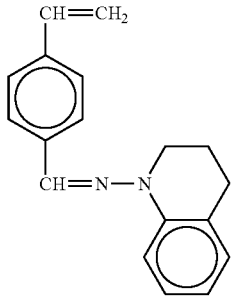

No. 158

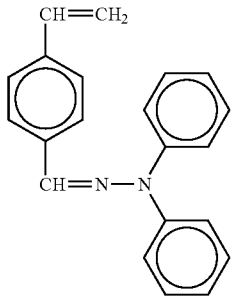

No. 159

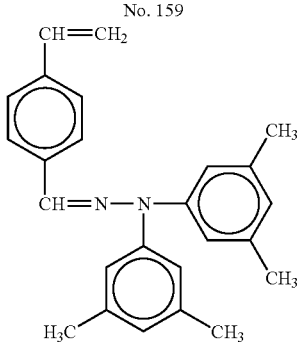

No. 160

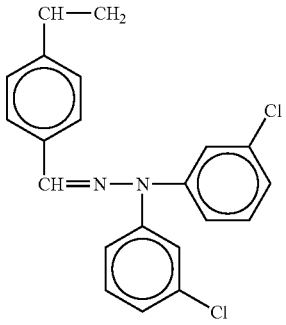

The radical polymeric compound having one functional group with a charge transporting structure for use in the present invention is essential for imparting a charge transportability to the crosslinked CTL, and is preferably included therein in an mount of 20 to 80% by weight, and more preferably from 30 to 70% by weight based on total weight thereof. When less than 20% by weight, the crosslinked CTL cannot maintain the charge transportability, a sensitivity of the resultant photoreceptor deteriorates and a residual potential thereof increases in repeated use. When greater than 80% by weight, a content of the monomer having three or more functional groups without a charge transporting structure decreases and the crosslinked density deteriorates, and therefore the resultant photoreceptor does not have a high abrasion resistance. Although it depends on a required abrasion resistance and electrical properties, in consideration of a balance therebetween, a content of the radical polymeric compound having one functional group with a charge transporting structure is most preferably from 30 to 70% by weight.

The crosslinked CTL of the present invention is formed by hardening at least the radical polymeric monomer having three or more functional groups without a charge transporting structure and the radical polymeric compound having one functional group with a charge transporting structure, and can include a radical polymeric monomer and a radical polymeric oligomer having one or two functional groups as well to control a viscosity of the layer when coated, reduce a stress of thereof, impart a low surface free energy thereto and reduce friction coefficient thereof. Known radical polymeric monomers and oligomers can be used.

Specific examples of the radical monomer having one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical monomer include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group with a repeat unit of from 20 to 70 disclosed in Japanese Patent Publications Nos. 5-60503 and 6-45770, such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl; acrylate; and methacrylate.

Specific examples of the radical polymeric oligomer includes epoxyacrylate oligomers, urethaneacrylate oligomers and polyetseracrylate oligomers. However, when the crosslinked CTL includes a large amount of the radical polymeric monomer and radical polymeric oligomer having one or two functional groups, the three-dimensional crosslinked bonding density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymeric monomer having three or more functional groups.

The crosslinked CTL, wherein at least the radical polymeric monomer having three or more functional groups without a charge transporting structure and the radical polymeric compound having one functional group with a charge transporting structure are hardened, can optionally include a polymerization initiator to effectively proceed the hardening reaction.

Specific examples of heat polymerization initiators include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of photo polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxi de, methylphenylglyoxyester, 9,10-phenanthrene, acridine compounds, triazine compounds and imidazole compounds. Further, a material having a photo polymeric effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the radical polymeric compounds.

Further, a coating liquid for the crosslinked CTL of the present invention may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. A content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. A content thereof is preferably not greater than 3% by weight.

The crosslinked CTL of the present invention is formed by coating and hardening a coating liquid including at least the radical polymeric monomer having three or more functional groups without a charge transporting structure and the radical polymeric compound having one functional group with a charge transporting structure. The coating liquid can include other components when the radical polymeric monomer is a liquid, and is optionally diluted with a solvent and coated. Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosoves such as methyl Cellosolve, ethyl Cellosolve and Cellosolve acetate. These solvents can be used alone or in combination. A dilution ratio with the solvent can optionally be decided upon solubility of the compositions, a coating method and a purposed layer thickness. The crosslinked CTL can be coated by a dip coating method, a spray coating method, a bead coating method, a ring coating method, etc.

In the present invention, after the coating liquid is coated to form layer, an external energy is applied thereto for hardening the layer to form the crosslinked CTL. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked CTL. To uniformly proceed the hardening reaction, after heated at comparatively a low temperature less than 100° C., the reaction is completed at not less than 100° C. Specific examples of the light energy include UV irradiators such as high-pressure mercury lamps and metal halide lamps having an emission wavelength of UV light; and a visible light source adaptable to absorption wavelength of the radical polymeric compounds and photo polymerization initiators. An irradiation light amount is preferably from 50 to 1,000 $mW/cm^2$. When less than 50 $mW/cm^2$, the hardening reaction takes time. When greater than 1,000 $mW/cm^2$, the reaction nonuniformly proceeds and the crosslinked CTL has a large surface roughness. The radiation energy includes a radiation energy using an electron beam. Among these energies, the heat and light energies are effectively used because of their simple reaction speed controls and simple apparatuses.

The crosslinked CTL of the present invention preferably has a thickness of from 1 to 10 μm, and more preferably from 2 to 8 μm. When thicker than 10 μm, the layer is liable to crack and peel. When not thicker than 8 μm, the crosslinked density can be higher, and further, materials and hardening conditions can be selected to increase the abrasion resistance. The radical polymerization reaction is liable to be disturbed with oxygen, i.e., the surface of the crosslinked CTL contacting the atmospheric air is not well crosslinked or nonuniformly crosslinked because of a radical trap of the oxygen. This noticeable appears when less than 1 μm, and the crosslinked CTL having a thickness less than 1 μm is liable to have deterioration in its abrasion resistance and nonuniform abrasion. In addition, the underlying CTL components mix in the crosslinked CTL when coated thereon. When the crosslinked CTL is thin, the crosslinked CTL is wholly contaminated with impurities, resulting in inhibition of the hardening reaction and deterioration of the crosslinked density. The crosslinked CTL of the present invention, having a thickness not less than 1 μm, has good abrasion resistance and scratch resistance, however, when locally abraded until the underlying CTL due to repeated use, the locally abraded part of the crosslinked CTL expands and the chargeability and sensitivity of the resultant photoreceptor vary, which is liable to produce halftone images having irregular image density. Therefore, the crosslinked CTL preferably has a thickness not less than 2 μm such that the resultant photoreceptor has a longer life and produces higher quality images, including a respect of maintaining the abrasion resistance thereof.

When an additive such as a binder resin not having a radical polymeric functional group, an antioxidant and a plasticizer besides the radical polymeric monomer having three or more functional groups without a charge transporting structure and the radical polymeric compound having one functional group with a charge transporting structure is included in the crosslinked CTL coating liquid in a large amount, a phase separation between the hardened material and the additive is formed, resulting in deterioration of the crosslinked density and soluble in an organic solvent. Specifically, it is essential that the additive is included in the coating liquid in an amount of not greater than 20% by weight based on total weight of solid contents therein. In addition, in order not to make the crosslinked density thin, a radical polymeric monomer having one or two functional groups, a reactive oligomer or a reactive polymer is preferably included therein in an amount not greater than 20% by weight based on total weight of the radical polymeric monomer having three or more functional groups. When a radical polymeric compound having two or more functional groups with a charge transport structure is included therein in a large amount, bulky structures plurally bonded and fixed in the crosslinked structure, and therefore the resultant crosslinked CTL is liable to become distorted and an aggregation of microscopic hardened materials. This is why the layer is occasionally soluble in an organic solvent. Although depending on the structure of the compound, the radical polymeric compound having two or more functional groups with a charge transport structure is preferably included therein in an amount not greater than 10% by weight based on total weight of the radical polymeric compound having one functional group with a charge transport structure. Further, when a CGL, a CTL and a crosslinked CTL are layered in this order, the outermost layer, i.e., the crosslinked CTL is preferably insoluble in an organic solvent in terms of abrasion and scratch resistance. In order to make the crosslinked CTL insoluble in an organic solvent, (1) controlling the constituents and contents thereof in the crosslinked CTL coating liquid, (2) controlling a diluent solvent and a concentration of solid contents therein, (3) selecting methods of coating the crosslinked CTL coating liquid, (4) controlling the hardening conditions of the crosslinked, (5) making the underlying CTL insoluble, etc. are essential. However, the method is not limited to only one of these.

When a solvent having a low evaporation rate is used as the diluent solvent for the crosslinked CTL coating liquid, a residual solvent prevents the hardening reaction and increases a mixed amount of the underlayer components, resulting in nonuniform crosslink and deterioration of crosslinked density. This is why the layer is liable to be soluble in an organic solvent. Specifically, tetrahydrofuran, a mixed solvent of tetrahydrofuran and methanol, ethyl acetate, methyl ethyl ketone, ethyl cellosolve, etc. are effectively used, and selected according to the coating method. When a concentration of solid contents is too low, the resultant layer is liable to be soluble in an organic solvent. A maximum concentration thereof is limited by limitations of the thickness of the layer and the viscosity of the coating liquid. Specifically, the solid contents are preferably included in the coating liquid in an amount of from 10 to 50% by weight. The coating liquid preferably includes a solvent as little as possible, and the underlayer preferably contacts the solvent for as short as possible. Specifically, a spray coating method and a ring coating method regulating an amount of the coating liquid are preferably used. In order to prevent the underlayer components from mixing in the crosslinked CTL, the CTL (underlayer) effectively includes a charge transport polymer material or an intermediate layer insoluble in the solvent used in the crosslinked CTL coating liquid is effectively formed therebetween.

The crosslinked CTL is not completely hardened when the heat or light irradiation energy is low, and is more soluble in an organic solvent. When hardened with a very high energy, the crosslinked CTL is nonuniformly hardened, wherein an uncrosslinked part and a radical discontinuation part increase, and is liable to have an aggregation of microscopic hardened materials. Therefore, the crosslinked CTL is occasionally soluble in an organic solvent. The crosslinked CTL is preferably hardened with a heat at from 100 to 170° C. for 10 min to 3 hrs, or with UV light irradiation at from 50 to 1,000 mW/cm$^2$ for 5 sec to 5 min, and at not higher than 50° C.

In order to form a crosslinked CTL insoluble in an organic solvent, an acrylate monomer having three acryloyloxy groups and a triarylamine compound having one acryloyloxy group are mixed at a ratio (acrylate monomer having three acryloyloxy groups/a triarylamine compound having one acryloyloxy group) of from 7/3 to 3/7 to prepare a mixture; a polymerization initiator is added thereto in an amount of from 3 to 20% by weight based on total weight thereof to prepare another mixture; and a solvent is added thereto to prepare a coating liquid. For example, when an underlayer of the crosslinked CTL, i.e., the CTL includes a triarylamine donor as a charge transport material and a polycarbonate resin as a binder resin, and the coating liquid is sprayed thereon, the solvent is preferably tetrahydrofuran, 2-butanone, ethylacetate, etc., in an amount of 3 to 10 times as much as the total weight of the mixture of the acrylate monomer having three acryloyloxy groups and the triarylamine compound having one acryloyloxy group.

On a substrate such as an aluminum cylinder, an undercoat layer, a CGL and a CTL are layered in this order to prepare a photoreceptor, and the coating liquid is sprayed thereon. Then, the photoreceptor is dried naturally or at comparatively a low temperature for a short time, i.e., at 25 to 80° C. for 1 to 10 min, and is irradiated with UV light or heated to harden the coated layer thereof.

A metal halide lamp, or the like, is preferably used to irradiate the UV light at an illuminance of from 50 to 1,000 mW/cm$^2$. For example, when the UV light having an illuminance of 500 mW/cm$^2$ is irradiated onto the photoreceptor (drum), plural lamps may circumferentially irradiate the drum for about 30 sec, seeing that the drum does not have a temperature higher than 50° C.

When heated, the heating temperature is preferably from 100 to 170° C., and an oven blower, or the like, is used as a heater. When the heating temperature is 150° C., the heating time is from 20 min to 3 hrs.

After hardened, further heated at from 100 to 150° C. for 10 to 30 min to reduce the residual solvent.

Thus, the electrophotographic photoreceptor of the present invention is prepared.

The photoreceptor of the present invention includes a radical polymeric monomer having three or more functional groups in the surface layer, which develops a three-dimensional network therein and a highly-hardened crosslinked CTL having quite a high crosslinked density is formed, resulting in a high abrasion resistance. When only a radical polymeric monomer having one and two functional groups is used, the crosslinked density is thin in the crosslinked CTL and the resultant photoreceptor does not have a significant abrasion resistance. When the crosslinked CTL includes a polymer material, development of the three-dimensional network is impaired and crosslinked density deteriorates, and therefore the resultant photoreceptor does not have sufficient abrasion resistance. Further, the polymer material is not compatible with a hardened material produced from a reaction of a radical polymeric composition (a radical polymeric monomer and a radical polymeric compound with a charge transporting structure), a local abrasion arises from a phase separation, resulting in a scratch on the surface of the resultant photoreceptor. To form the crosslinked CTL of the present invention, in addition to the radical polymeric monomer having three or more functional groups, the radical polymeric compound having one functional group with a charge transporting structure is included therein when the radical polymeric monomer having three or more functional groups is hardened. On the contrary, when a low-molecular-weight charge transport material without a functional group is included in the crosslinked CTL, the low-molecular-weight charge transport material separates out and the crosslinked CTL becomes clouded because of the low compatibility, and mechanical strength of the crosslinked CTL deteriorates. When a charge transport material having two or more functional groups, although they are fixed with plural bondings in the crosslinked structure, a distortion arises in a hardening resin because the charge transporting structure is extremely bulky and an internal stress in the crosslinked CTL increases, resulting in frequent cracks and scratches thereon due to carrier adherence.

Further, the photoreceptor of the present invention has good electrical properties, and therefore produces high-quality images for long periods. This is because the radical polymeric compound having one functional group with a charge transporting structure is fixed in the shape of a pendant between the crosslinked bondings. As mentioned above, a charge transport material without a functional group is included in the crosslinked CTL separates out and the crosslinked CTL becomes clouded, resulting in lower sensitivity, increase of the residual potential and deterioration of the photoreceptor. Further, since the charge transport material having two or more functional groups are fixed with plural bondings in the crosslinked structure, an intermediate structure (cation radical) when a charge is transported cannot stably be maintained, resulting in deterioration of sensitivity due to a charge trap and increase of a residual potential. This deterioration of electrical properties results in deterioration of image density and thinner letter images.

Further, it is considered that the crosslinked CTL has much less variation of mechanical properties and surface properties due to a heat because a glass transition temperature thereof increase in addition to the very good abrasion resistance. Typically, when the glass transition temperature increase, the mechanical strength of a resin improve, however, when the glass transition temperature is too high, the toughness required for the surface of the photoreceptor deteriorates and vulnerability thereof increases, resulting in deterioration of abrasion resistance, scratches with a cleaning blade and a shorter life of the photoreceptor. However, the crosslinked CTL of the present invention has higher hardness and does not have lower elasticity, and the elasticity and toughness thereof rather increase.

A photoreceptor including the crosslinked CTL of the present invention is preferably used in combination with a non-contact charger located close to the surface thereof in an image forming apparatus. This is because (1) the layer is not liable to be influenced by a heat, (2) the layer is not liable to be influenced by a stress when charged, (3) the layer has a small internal stress and an influence when charged does not expand even when a particular part is influenced thereby, (4) the layer has high smoothness and scratch resistance, and charged products and contaminants can easily be removed with a cleaning blade without going into the scratches even when adhered thereto.

The photoreceptor of the present invention can have an intermediate layer between the crosslinked CTL and the CTL to prevent components of the CTL from mixing in the crosslinked CTL and improve adhesiveness therebetween. The intermediate layer is preferably insoluble or hardly soluble in a crosslinked CTL coating liquid and includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the substrate (31) and the photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-Containing Compounds

Dilauryl-3,3'-thiodipropionate, distearyl-3,3'-thiodipropionate, ditetradecyl-3,3'-thiodipropionate, etc.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained.

Each of the layers preferably includes the antioxidant in an amount of from 0.01 to 10% by weight based on total weight thereof.

Next, the electrophotographic image forming method and electrophotographic image forming apparatus of the present invention will be explained in detail, referring to the drawings. The electrophotographic image forming apparatus of the present invention is an electrophotographic image forming apparatus capable of forming images by repeating at least processes of charging a photoreceptor; irradiating the photoreceptor to form an electrostatic latent image thereon; developing the electrostatic latent image with a toner to form a toner image thereon; transferring the toner image onto an image holder (a transfer paper); fixing the toner image thereon; and cleaning the surface of the photoreceptor, wherein a surface layer of the photoreceptor is a crosslinked charge transport layer formed by hardening at least a radical polymeric monomer having three or more functional groups without a charge transport structure and a radical polymeric compound having one functional group with a charge transporting structure. The above mentioned processes are an embodiment of forming images in an electrophotographic image forming apparatus, which does not need all of the processes and can have other means.

Figure 2:
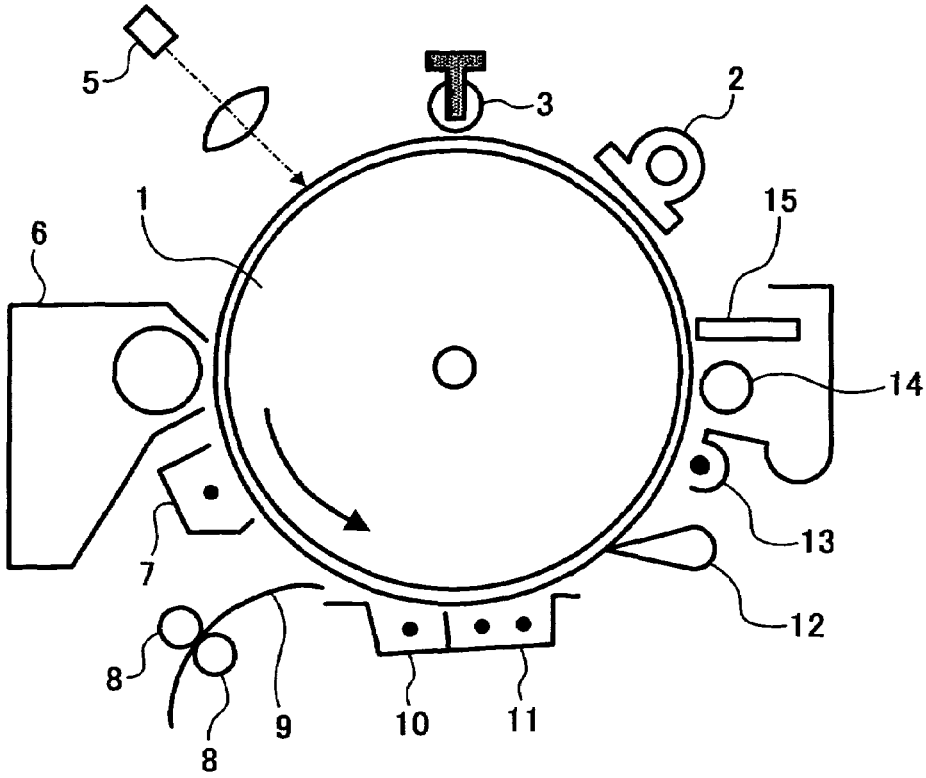
FIG. 2 is a schematic view illustrating a partial cross-section of an embodiment of the image forming apparatus of the present invention.

FIG. 2 is a schematic view illustrating a partial cross-section of an embodiment of the image forming apparatus of the present invention. A photoreceptor (1) is the photoreceptor of the present invention. The photoreceptor (1) has the shape of a drum, and may have the shape of a sheet or an endless belt.

A charging member (3) is mostly a charging roller device, and the photoreceptor and the charging member are located close to each other so as not to contact each other. As a method of placing the charging member close to the photoreceptor, a gap needs to be formed in a non-image forming area thereof, which includes forming a gap former on the charging member, the photoreceptor or flanges set on both sides thereof.

Figure 3:
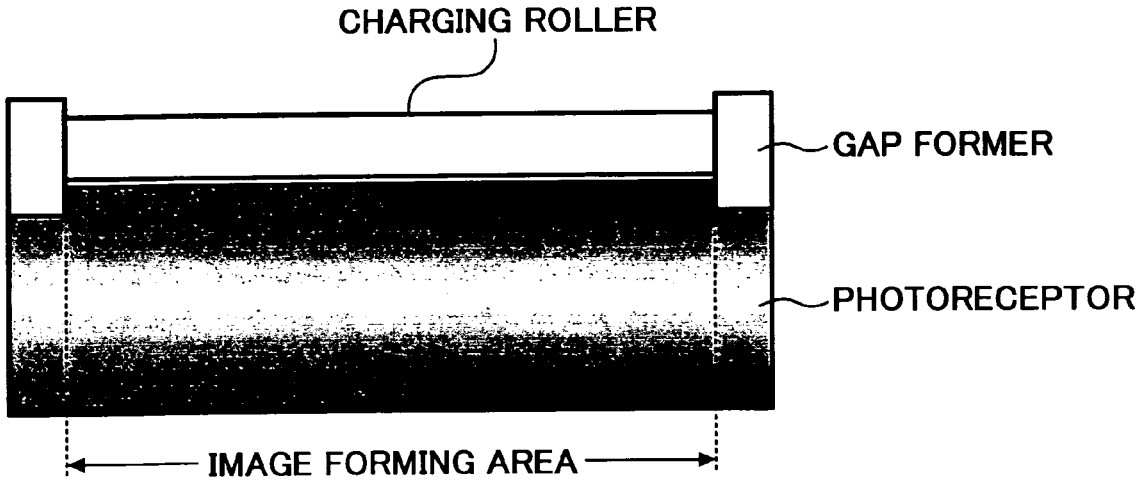
FIG. 3 is a schematic view illustrating an embodiment of the non-contact charger of the present invention.

FIG. 3 is a schematic view illustrating an embodiment of the non-contact charger of the present invention, wherein a gap former is formed on the charging member. The gap former needs to be insulative, and an abrasion resistant material is effectively used. The gap former may have the shapes of any things such as a tape, a seal and a tube. The gap preferably has a clearance of from 10 to 200 μm, more preferably from 20 to 100 μm, and furthermore preferably from 40 to 80 μm. When less than 10 μm, the non-contact charger has no advantage and the possibility of production of poor images increases. When greater than 200 μm, the photoreceptor is not stably charged and irregularly charged, an applied voltage to maintain a charged level required thereof needs to be increased, resulting in increase of the charged products causing blurred images.

An AC voltage overlapped with a DC voltage can be applied to the charging member to reduce irregular charges of the photoreceptor, causing irregular image density and deterioration of image contrast.

Next, an imagewise light irradiator (5) is used to form an electrostatic latent image on the photoreceptor (1). Suitable light sources thereof include typical light emitters such as a fluorescent lamp, a tungsten lamp, a halogen lamp, a mercury lamp, a sodium lamp, a light emitting diode (LED), a laser diode (LD), a light sources using electroluminescence (EL), etc. In addition, to obtain light having a desired wave length range, filters such as a sharp-cut filter, a band pass filter, a near-infrared cut filter, a dichroic filter, an interference filter and a color conversion filter can be used. Next, a developing unit (6) is used to visualize an electrostatic latent image formed on the photoreceptor (1).

The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to perform the transfer better. Suitable transferers include a transferer charger, an electrostatic transferer using a bias roller, an adhesion transferer, a mechanical transferer using a pressure and a magnetic transferer. The above-mentioned chargers can be used for the electrostatic transferer.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination.

Next, a discharger is optionally used to remove a latent image in the photoreceptor. The discharger includes a discharge lamp (2) and a discharger, and the above-mentioned light sources and chargers can be used respectively.

Known means can be used for other processes such as an original reading process, a paper feed process, a fixing process and a paper delivery process.

The above-mentioned electrophotographic process is an embodiment of the present invention, and other embodiments can also be used, e.g., the light irradiation processes include the imagewise light irradiation, the pre-cleaning irradiation and the discharge irradiation, and can also include a pre-transfer irradiation, a pre-irradiation before the imagewise light irradiation and other irradiation processes to irradiate the photoreceptor.

The above-mentioned image forming unit may be fixedly set in a copier, a facsimile or a printer, and may be detachably set therein as a process cartridge.

Figure 4:
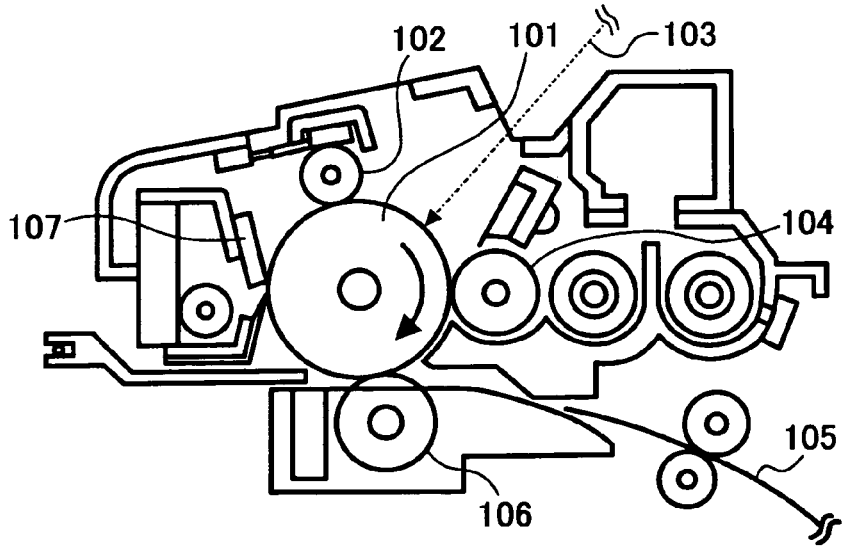
FIG. 4 is a schematic view illustrating a cross-section of an embodiment of the process cartridge for the image forming apparatus of the present invention.

FIG. 4 is a schematic view illustrating a cross-section of an embodiment of the process cartridge for the image forming apparatus of the present invention.

The process cartridge is an image forming unit (or device) which includes a photoreceptor (101), the outermost layer of which is the crosslinked CTL including a radical polymeric monomer having three or more functional groups without a charge transport structure and a radical polymeric compound having one functional group with a charge transporting structure of the present invention, and at least one of a charger (102), an image developer (104), a transferer (106), a cleaner (107) and a discharger (not shown).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The compound having one functional group with a charge transport structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream. 99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared.

A

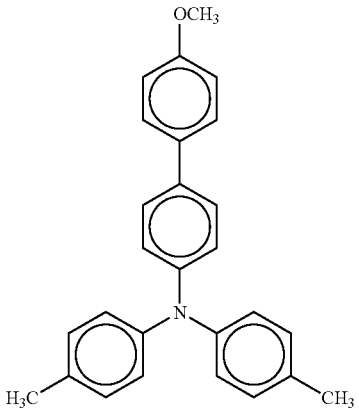

B

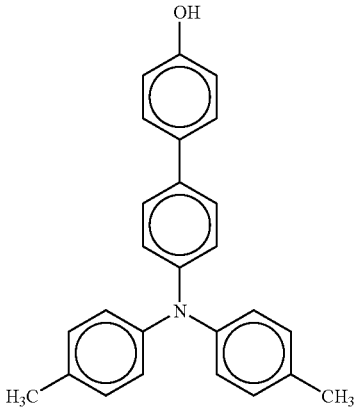

Element analytical value (%)

| | C | H | N |
|---|---|---|---|
| Actual measurement | 85.06 | 6.41 | 3.73 |
| Calculated value | 85.44 | 6.34 | 3.83 |

(2) A Triarylamino Group Substituted Acrylate Compound (Compound No. 54 in Table 1)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared.

No. 54

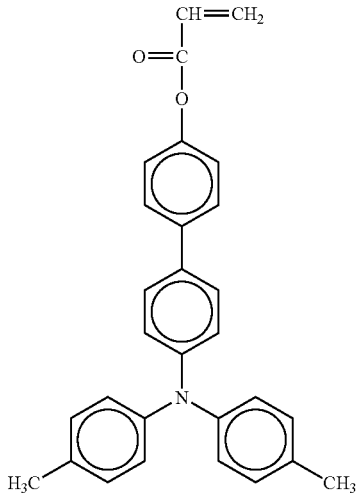

Element analytical value (%)

| | C | H | N |
|---|---|---|---|
| Actual measurement | 83.13 | 6.01 | 3.16 |
| Calculated value | 83.02 | 6.00 | 3.33 |

Example 1

Undercoat Layer Formation

A methanol solution including a polyamide resin (AMILAN CM8000 from Toray industries, Inc. at a concentration of 5% was coated on an aluminum cylinder having a diameter of 30 mm and a length of 340 mm to form an undercoat layer having a thickness of 0.3 μm. The aluminum cylinder was subjected to a metal cutting process such that moiré does not occur.

CGL Formation 10 parts of an oxytitaniumphthalocyanine pigment having a CuKα X-ray diffraction main peaks at a 2θ±0.2° angle of 9.0°, 14.2°, 23.9° and 27.1°; 10 parts of a polycarbonate Z resin having a weight-average molecular weight of 28,000; and 60 parts of cyclohexanone were dispersed by a sand mill using glass beads having a diameter of 1 mm for 20 hrs to prepare a dispersion. 100 parts of methyl ethyl ketone were added thereto to prepare a CGL coating liquid, and the liquid was coated and dried on the undercoat layer to form a CGL having a thickness of 0.12 μm thereon.

CTL Formation 7 parts of a triarylamine compound having the following formula:

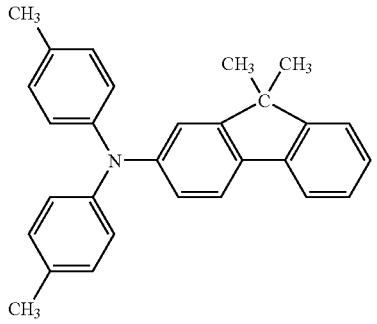

3 parts of a styryl compound having the following formula:

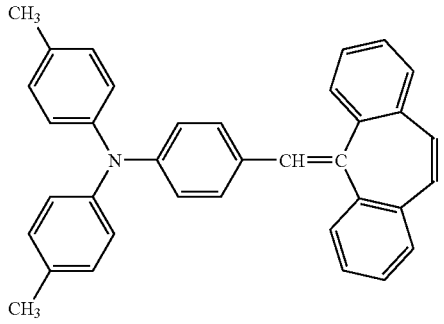

and 10 parts of a polycarbonate Z resin having a weight-average molecular weight of 80,000 were dissolved in 60 parts of monochlorobenzene to prepare a CTL coating liquid. The liquid was coated and dried on the CGL to form a CTL having a thickness of 20 μm thereon.

Crosslinked CTL Formation

The CTL was further coated with a crosslinked CTL coating liquid prepared by the following formulation by a spray coating method.

| | |
|---|---|
| Radical polymeric monomer having three or more functional groups without a charge transport structure trimethylolpropanetriacrylate (KAYARAD TMPTA from NIPPON KAYAKU CO., LTD.) having a molecular weight (Mw) of 296, 3 functional groups and Mw/3 of 99 | 10 |
| Radical polymeric compound having one functional group with a charge transporting structure (Exemplified compound No. 54) | 10 |
| Photo polymerization initiator (1-hydroxy-cyclohexyl-phenyl-ketone IRGACURE 184 from CIBA SPECIALTY CHEMICALS) | 1 |
| Tetrahydrofuran | 100 |

The coated layer was naturally dried for 20 min, and irradiated by a metal halide lamp having a capacity of 160 W/cm at a distance of 120 mm and an irradiation intensity of 500 mW/cm$^2$ for 60 sec to harden the coated layer, and further dried at 130° C. for 20 min to form a crosslinked CTL having a thickness of 5.3 μm.

Thus an electrophotographic photoreceptor of Example 1 was prepared.

Example 2

The procedure for preparation of the electrophotographic photoreceptor in Example 1 was repeated to prepare an electrophotographic photoreceptor of Example 2 except for changing the thickness of the crosslinked CTL to 1.3 μm.

Example 3

The procedure for preparation of the electrophotographic photoreceptor in Example 1 was repeated to prepare an electrophotographic photoreceptor of Example 3 except for changing the thickness of the crosslinked CTL to 7.7 μm.

Example 4

The procedure for preparation of the electrophotographic photoreceptor in Example 1 was repeated to prepare an electrophotographic photoreceptor of Example 4 except for replacing the radical polymeric monomer having three or more functional groups without a charge transporting structure included in the crosslinked CTL coating liquid with the following monomer:

Pentaerythritoltetraacrylate SR-295 having a molecular weight (Mw) of 352, four function groups (Fg), and a ratio (Mw/Fg) of 88 from Sartomer Company, Inc., the radical polymeric compound having one functional group with a charge transporting structure with the exemplified compound No. 138, and changing the thickness of the crosslinked CTL to 5.4 μm.

Example 5

The procedure for preparation of the electrophotographic photoreceptor in Example 4 was repeated to prepare an electrophotographic photoreceptor of Example 5 except for changing the thickness of the crosslinked CTL to 1.4 μm.

Example 6

The procedure for preparation of the electrophotographic photoreceptor in Example 4 was repeated to prepare an electrophotographic photoreceptor of Example 6 except for changing the thickness of the crosslinked CTL to 7.7 μm.

Example 7

The procedure for preparation of the electrophotographic photoreceptor in Example 1 was repeated to prepare an electrophotographic photoreceptor of Example 7 except for replacing the radical polymeric monomer having three or more functional groups without a charge transporting structure and the radical polymeric compound having one functional group with a charge transporting structure included in the crosslinked CTL coating liquid with the following monomer and compound respectively:

Caprolactone-modified dipentaerythritolhexaacrylate

KAYARAD DPCA-60 having a molecular weight (Mw) of 1,263, 6 function groups (Fg), and a ratio (Mw/Fg) of 211 from Nippon Kayaku Co., Ltd., and 2,2-dimethoxy-1,2-diphenylethane-1-one IRGACURE 651 from CIBA SPECIALTY CHEMICALS and changing the thickness of the crosslinked CTL to 5.0 μm.

Example 8

The procedure for preparation of the electrophotographic photoreceptor in Example 7 was repeated to prepare an electrophotographic photoreceptor of Example 8 except for changing the thickness of the crosslinked CTL to 9.6 μm.

Example 9

The procedure for preparation of the electrophotographic photoreceptor in Example 7 was repeated to prepare an electrophotographic photoreceptor of Example 9 except for changing the thickness of the crosslinked CTL to 1.9 μm.

Example 10

The procedure for preparation of the electrophotographic photoreceptor in Example 7 was repeated to prepare an electrophotographic photoreceptor of Example 10 except for changing the thickness of the crosslinked CTL to 2.4 μm.

Comparative Example 1

The procedure for preparation of the electrophotographic photoreceptor in Example 1 was repeated to prepare an electrophotographic photoreceptor of Comparative Example 1 except for not forming the crosslinked CTL and changing the thickness of the CTL to 25 μm.

Comparative Example 2

The procedure for preparation of the electrophotographic photoreceptor in Example 1 was repeated to prepare an electrophotographic photoreceptor of Comparative Example 2 except for not forming the crosslinked CTL and forming a protective layer having a thickness of 2.0 μm on the CTL by spray-coating a liquid including 25 parts of an acrylic hardening monomer having the following formula:

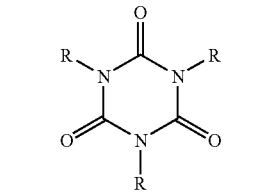

R: —CH2CH2OCOCH═CH2

2.0 parts of 2-methylthioxanetone and 300 parts of toluene, drying the liquid, and irradiating UV light to the photoreceptor with a high-pressure mercury lamp at a light intensity of 800 mW/cm$^2$ for 20 sec.

Comparative Example 3

The procedure for preparation of the electrophotographic photoreceptor in Example 1 was repeated to prepare an electrophotographic photoreceptor of Comparative Example 3 except for not forming the crosslinked CTL and forming an adhesive layer having a thickness of 0.3 μm by coating a coating liquid having the following formulation and heating the liquid at 100° C. for 30 min:

| | |
|---|---|
| Silylacrylate (PC-7A from Shin-Etsu Chemical Co., Ltd.) | 6 |
| 2-butanone | 200 |

and forming a protective layer having a thickness of 3 μm thereon by the following method:

adding MOLECULAR SIEVE 4A to a methanol solution of polysiloxane including methyl siloxane and methyl-phenyl siloxane in an amount of 80 mol % and 20 mol % respectively; leaving the methanol solution for 15 hrs to be dehydrated; dissolving 10 parts of the dehydrated methanol solution in 10 parts of toluene; further adding 1 part of methyltrimethoxy silane and 0.2 parts of dibutyltin acetate to the solution to be uniformed; coating the solution on the adhesive layer; and hardening the solution upon application of heat at 120° C. for 1 hr.

Comparative Example 4

The procedure for preparation of the electrophotographic photoreceptor in Example 1 was repeated to prepare an electrophotographic photoreceptor of Comparative Example 4 except for replacing the radical polymeric compound having one functional group with a charge transporting structure with a bifunctional radical polymeric compound having a charge transport structure, having the following formula:

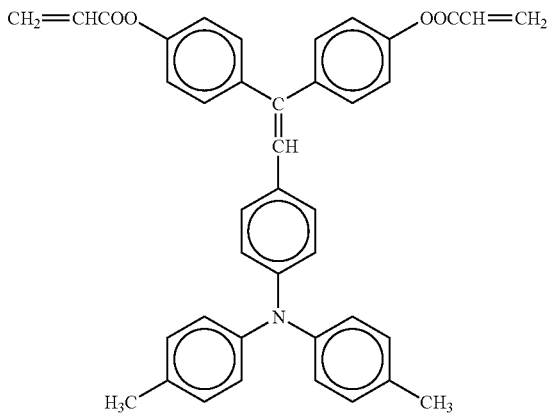

Each of the electrophotographic photoreceptors 1 to 10 prepared in Examples to 10 and Comparative Examples 1 to 4 was installed in a process cartridge, and the process cartridge (without a pre-cleaning irradiator) was installed in a modified imagio MF2730 from Ricoh Company, Ltd. to evaluate images produced thereby. A PET tape having a thickness of 50 μm was wound around both sides (non-image forming area) of a charging roller therein to be located close to a photoreceptor therein. An AC voltage (1.35 kHz and 1.8 kV (peak to peak)) overlapped with a DC voltage (−850 V) was applied to the charging roller.

After 60,000 images were continuously produced thereby, the image was evaluated in an environment of 25° C. and 50% RH, and 30° C. and 90% RH. An abraded amount of the crosslinked CTL was measured after 10,000 images were produced. The evaluation results are shown in Table 2.

The image quality was classified to the following 4 grades:

◎: good

○: acceptable

Δ: unacceptable

×: unreadable

The abraded amount was measured by a FISCHER SCOPE MMS from Helmut Fischer GmbH+Co. KG.

TABLE 2

| Examples & Comparative Examples | Image Evaluation After 60,000 25° C. 50% RH | Image Evaluation After 60,000 30° C. 90% RH | Abraded amount (μm) |
|---|---|---|---|
| Example 1 | ◎ Good | ◎ Good | 1.1 |
| Example 2 | ○ Slight stripe contamination | ○ Slight stripe contamination | 1.2 |
| Example 3 | ◎ Good | ◎ Good | 1.1 |
| Example 4 | ◎ Good | ◎ Good | 1.0 |
| Example 5 | ○ Slight stripe contamination | ○ Slight stripe contamination | 1.2 |
| Example 6 | ◎ Good | ◎ Good | 1.0 |
| Example 7 | ◎ Good | ◎ Good | 1.3 |
| Example 8 | ◎ Good | ◎ Good | 1.4 |
| Example 9 | ○ Slight stripe contamination | ○ Slight stripe contamination | 1.5 |
| Example 10 | ◎ Good | ◎ Good | 1.5 |
| Comparative Example 1 | X Whole background contaminated | X Whole background contaminated | 6.0 |
| Comparative Example 2 | Δ Image density deteriorated | X Image density deteriorated, and image distorted | 1.0 |
| Comparative Example 3 | Δ Image resolution slightly deteriorated | X Whole image distorted | 2.5 |
| Comparative Example 4 | Δ Stripe contamination | X Frequent stripe contamination | * |

This application claims priority and contains subject matter related to Japanese Patent Application No. 2004-257823 filed on Sep. 6, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

The invention claimed is:

1. An image forming apparatus comprising:

an electrophotographic photoreceptor;

a non-contact charger located and configured so as to be able to charge the electrophotographic photoreceptor;

an irradiator configured to irradiate the electrophotographic photoreceptor to form an electrostatic latent image thereon;

an image developer configured to develop the electrostatic latent image with a toner to form a toner image on the electrophotographic photoreceptor; and a transferer configured to transfer the toner image onto a transfer material, wherein the electrophotographic photoreceptor comprises:

an electroconductive substrate;

a charge generation layer located overlying the electroconductive substrate;

a charge transport layer located overlying the charge generation layer; and a crosslinked charge transport layer, located overlying the charge transport layer, wherein;

the crosslinked charge transport layer is formed by hardening a composition comprising a radical polymeric monomer having three or more functional groups without a charge transport structure and a radical polymeric compound having one functional group with a charge transporting structure; and at least one of the radical polymeric monomer having three or more functional groups without a charge transport structure and the radical polymeric compound having one functional group with a charge transporting structure comprise at least one functional group selected from the group consisting of acryloyloxy groups and methacryloyloxy groups.

2. The image forming apparatus of claim 1, wherein the crosslinked charge transport layer has a thickness of from 1 to 10 μm.

3. The image forming apparatus of claim 1, wherein the crosslinked charge transport layer has a thickness of from 2 to 8 μm.

4. The image forming apparatus of claim 1, wherein the non-contact charger is a charging roller.

5. The image forming apparatus of claim 4, wherein the charging roller is applied with an AC voltage overlapped with a DC voltage to charge the electrophotographic photoreceptor.

6. The image forming apparatus of claim 4, wherein the charging roller and the electrophotographic photoreceptor have a gap clearance not greater than 100 μm therebetween.

7. A process cartridge comprising:

an electrophotographic photoreceptor; and at least one of a non-contact charger located and configured so as to be able to charge the electrophotographic photoreceptor;

an irradiator configured to irradiate the electrophotographic photoreceptor to form an electrostatic latent image thereon;

an image developer configured to develop the electrostatic latent image with a toner to form a toner image on the electrophotographic photoreceptor; and a cleaner configured to remove the toner remaining on the electrophotographic photoreceptor wherein the electrophotographic photoreceptor comprises:

an electroconductive substrate;

a charge generation layer located overlying the electroconductive substrate;

a charge transport layer located overlying the charge generation layer; and a crosslinked charge transport layer, located overlying the charge transport layer, wherein:

the crosslinked charge transport layer is formed by hardening a composition comprising a radical polymeric monomer having three or more functional groups without a charge transport structure and a radical polymeric compound having one functional group with a charge transporting structure; and at least one of the radical polymeric monomer having three or more functional groups without a charge transport structure and the radical polymeric compound having one functional group with a charge transporting structure comprise at least one functional group selected from the group consisting of acryloyloxy groups and methacryloyloxy groups; and the process cartridge is configured to be detachable from an image forming apparatus.

8. An electrophotographic photoreceptor comprising:

an electroconductive substrate;

a charge generation layer located overlying the electroconductive substrate;

a charge transport layer located overlying the charge generation layer; and a crosslinked charge transport layer, located overlying the charge transport layer, wherein:

the crosslinked charge transport layer is formed by hardening a composition comprising radical polymeric monomer having three or more functional groups without a charge transport structure and a radical polymeric compound having one functional group with a charge transporting structure; and at least one of the radical polymeric monomer having three or more functional groups without a charge transport structure and the radical polymeric compound having one functional group with a charge transporting structure comprise at least one functional group selected from the group consisting of acryloyloxy groups and methacryloyloxy groups.

* * * * *